US007736557B2

(12) United States Patent
Evans et al.

(10) Patent No.: US 7,736,557 B2
(45) Date of Patent: Jun. 15, 2010

(54) AGED ROOFING TILE SYSTEM

(75) Inventors: Michael M. Evans, Centerville, UT (US); Lewis M. Evans, Salt Lake City, UT (US); James D. Brasher, Reno, NV (US)

(73) Assignee: Evans Brothers Investments, Centerville, UT (US)

( * ) Notice: Subject to any disclaimer, the term of this patent is extended or adjusted under 35 U.S.C. 154(b) by 626 days.

(21) Appl. No.: 10/725,991

(22) Filed: Dec. 2, 2003

(65) Prior Publication Data

US 2005/0116373 A1 Jun. 2, 2005

(51) Int. Cl.
*B28B 11/04* (2006.01)
*E04D 1/00* (2006.01)

(52) U.S. Cl. ..... 264/74; 264/132; 264/DIG. 31; 52/518

(58) Field of Classification Search ..... 264/73, 264/132, DIG. 31, 133, 74; D25/145, 139; 52/518

See application file for complete search history.

(56) References Cited

U.S. PATENT DOCUMENTS 1,993,086 A * 3/1935 Chaffee ..... 52/542
2,057,679 A * 10/1936 Gundlach ..... 442/69
2,629,135 A * 2/1953 Johnson ..... 264/426
2,835,996 A * 5/1958 De Paoli, Sr. ..... 52/315
2,918,385 A * 12/1959 Arpin et al. ..... 106/639
4,743,471 A * 5/1988 Shills, III ..... 427/262
4,940,358 A * 7/1990 Maletic ..... 404/93
5,648,144 A * 7/1997 Maurer et al. ..... 428/141

OTHER PUBLICATIONS

Lehrer, J., Online NewsHour Transcript: Jackson Pollock, (Jan. 1999), 7 pages. Archived version from Apr. 2002.*
Monier Colors Southwest Catalog, Aug. 1993, pp. 1-16.
Declaration of James D. Brasher, Apr. 2, 2005, pp. 1-2.
Declaration of Michael M. Evans, Apr. 28, 2005, pp. 1-2.

* cited by examiner

*Primary Examiner*—Matthew J. Daniels
(74) *Attorney, Agent, or Firm*—Pate Pierce & Baird

(57) ABSTRACT

A system, method, and apparatus for constructing and installing a roofing tile having an arbitrary design of color, patterns, textures, and the like in accordance with the requirements of a user, a designer, an architect, or the like, and provides an ability to select a color scheme for a base tile, variegations within the color of the base tile, as well as accent medallions having color, textures, and the like. Moreover, a texture may be provided to improve adhesion of the accent medallions to the base tile. In alternative embodiments, no texturing is required, but may be provided simply as a design element affecting shading in varied lighting.

57 Claims, 16 Drawing Sheets

AGED ROOFING TILE SYSTEM

BACKGROUND

1. The Field of the Invention

This invention relates to roofing tiles, and more particularly to methods of designing and decorating concrete and clay roofing tiles.

2. The Background Art

Tile is a roofing material used for centuries, even millennia. It is heavy, thick, durable, comparatively impervious to weather, requiring no maintenance or a minimum degree of periodic repair and replacement, sometimes colorful, and ultimately a very useful roof covering material. On the one hand, the durability and appearance of tile seem almost ageless and timeless.

On the other hand, tile actually ages. Typically, the fines within concrete tile or even clay tile, can recede to a certain extent leaving more of the larger aggregate exposed over time. This provides a certain amount of texture. Also, like rock, the rigid, stable, weathered tiles eventually may pick up dust, minerals, spores, and the like.

Typically, a variety of lichens and mosses will attach themselves and propagate on tile over time. Lichens and mosses may have a variety of characteristic colors depending on the particular area, climate, sun, moisture, and the like. Mosses and lichens typically require differing amounts of moisture. For example, mosses usually require substantially more water or humidity than do lichens. Accordingly, mosses tend to propagate in water, near water, in crevices where capillary action has trapped water, in humid environments, and the like. By contrast, lichens propagate in plentiful varieties in areas ranging from humid and moist, to those that are comparatively very arid.

Lichens are not a single species of organism. Lichens are any of the complex organisms in group Lichenes, composed of two organisms. That is, a fungus provides an underlying organism for a symbiotic union with an alga. Typically, lichens have one or more colors appearing greenish, gray, yellow, brown, or black. Lichen colors have been compared to the color of sagebrush leaves, bright chartreuse, dark forest green, ochre, yellow, reddish, rust, and the like.

The algae are an organism of a type called thallus. A thallus grows in a branching form on rocks, trees, tiles, and the like as a leaf-like or crust-like material. A thallus is a simple vegetative body undifferentiated into true leaves, stems, roots, or the like. Typically, a thallus ranges from an aggregation of filaments to a complex plant-like form. Lichens appear to embody some of the simplest forms of thallus.

Often, in lichens, a fungus is first to establish. Lichens can often be observed as colonies of gray (light gray to virtually black) expanses of fungus dotted by small and large colorful algae. In general, a fungus is any of a diverse group of eukaryotic single-celled, or multinucleate organisms that live by decomposing and absorbing the organic material in which they grow.

For example, mushrooms, molds, mildews, smuts, rusts, and yeasts are all classified within the kingdom fungi, or in the division fungi (Thallophyta) in the kingdom Plantae. Thus, fungi may begin to attach themselves to rocks, tiles, trees, and the like and absorb nutrients therefrom while also relying on the sun, air and humidity. Fungus lack chlorophyll and thus need algae. Algae obtain attachment and nutrients from fungi, as well as a more consistent body of moisture.

Algae comprise any of numerous groups of chlorophyll-containing, and mainly aquatic eukaryotic organisms. They range from microscopic single-celled forms to multicellular forms in huge colonies 100 feet (30 meters) or more long. Algae distinguish from plants by the absence of true roots, stems, leaves, and the like. Thus, algae is structurally a thallus. Similarly, algae do not have structures that do not contain nonreproductive cells. The reproductive structures stand alone. Algae are typically classified into six phyla including Euglenophyta, Chrysophyta, Pyrrophyta, Chlorophyta, Phaeophyta, and Rhodophyta. In accordance with the Latin naming conventions, a single alga is one of multiple algae.

Algae come in a number of varieties. For example, one common form of algae is widely distributed, and is identified as a group of predominately photosynthetic prokaryotic organisms of the subkingdom Cyanophyta. These are sometimes called cyanobacteria. This relates to the photosynthesis and nitrogen fixation that these organisms are capable of. Some algae can fix atmospheric nitrogen. They may occur in single or colony structures. Habitats vary widely.

All of this is interesting primarily as it affects roofing systems. Being stable, unmoved, comparatively rigid rather than flexible, exposed to humidity, moisture, dust, and other climatological phenomenon, as well as sun, shade, and so forth, tile presents a reasonable habitat for algae, fungus, and lichens.

Tiles, and even shingles, also sometimes accumulate mosses. Because tiles overlap one another, a thin joint is formed at the bottom of substantially each tile where it rests upon the top portion of a subsequent, lower, adjacent tile. Capillary action is significant for water whenever a gap, channel, cavity, or the like has a diameter (or other significant gap) less than about a quarter of an inch. In gaps, interstices, channels, and the like having a characteristic length of greater than one-quarter inch, gravity, wind, and other phenomena may tend to dominate. However, people realize that capillary spaces, notably medical glass capillaries formed as small round cylindrical tubes, will actually rely on the surface tension force of liquid, such as blood or water, to draw itself up through the capillary.

Similarly, water flowing from the bottom of a tile can fill and remain within the capillary gap formed by the bottom of one tile overlapping the top portion of another. In effect, the capillary gap between tiles is effective to maintain a reservoir of moisture. This reservoir provides a substantial and reasonably durable source of moisture for establishing mosses. Accordingly, mosses often form at the lower edge of the end face of a tile, growing as a protuberance almost appearing like a fillet in the corner between the end face of one tile and the top surface of an adjacent, lower tile thereunder.

Some mosses require less moisture than others. Likewise, some climates provide more moisture than others. Accordingly, mosses may sometimes grow on top of tiles. Nevertheless, suffice it to say that combinations of mosses, lichens, and the like may establish themselves on the top surfaces, at crevices, and the like corresponding to roof structures having a tiled covering.

One may note that rain is typically comprised of nucleated drops of water, wherein each nucleus is a particle of dust in the air. Typically, snow flakes are nucleated about a particle of dust to which crystals begin to agglomerate and structure themselves into a flake. Thus, as clean and pristine as water and snow appear to the eye, a substantial amount of dust or soil is transported thereby. Accordingly, roofs accumulate a certain amount of dust.

Water tends to wash a roof clean, but within the nap of texture existing on tile, a certain amount of dust or particulates may remain. Moreover, dust and particulate matter can settle out of the atmosphere directly. Accordingly, a certain amount of "soil" accumulates on a tile, and in crevices on the upper surfaces thereof. This provides a source of nutrients, and a slight bed for holding moisture to support biota. In general, we may refer herein to biota as any living organism capable of propagating. Thus, biota will include mosses, lichens, fungus, algae, and even organisms that may be classified as animals, such as bacteria. Nevertheless, lower life forms often blur the distinction between the plant kingdom and the animal kingdom.

A tile roof of an age of fifty or more years, is an interesting work, virtually a work of art. Over a period of decades, centuries, and even millennia, a tile roof will have a color scheme far different from that of a newly installed tile roof. That is, considering the foregoing discussion of the implantation and propagation of biota on a tile roof, a tile roof may have a widely variegated, sometimes very colorful, and peculiarly accented color scheme. The base or tile will have a color, and any biota propagating and growing thereon will have there own unique colors. Colonies may vary in size, and thus the extent to which a biotic colony covers one or more tiles, will vary.

Similarly, the natural weathering tends to raise in relief larger rock or sand (aggregate) pieces while a certain degree of wear causes receding of the fines, cement, or other interstitial material of smaller effective diameter. For purposes of this discussion, effective diameter may be considered to be hydraulic diameter, that is, an area and a circumference may be used to define an effective diameter or hydraulic diameter that is four times the area divided by the wetted perimeter. Instead of an actual total perimeter, one may simply use a mean perimeter. However, all masses have a center of mass, and effective diameter that they would contain had they been massed in a smooth circle or sphere. Accordingly, effective diameter may be selected by a user to be either a hydraulic diameter (four times the area divided by the wetted perimeter), or an effective diameter constituting an area or volume characterized by the diameter that would be required to contain all of the area or volume thereof.

Modem construction technique have long provided for uniform, precise, repeatable forms of manufacturing substantially all materials. Structural members, whether wood or metal, covering materials of all varieties, internal infrastructure, and the like are all produced according to standards that give precise and repeatable results.

By contrast, technological innovation in building materials has been an advancing art. In years, centuries, and millennia past, more primitive methods were often required. For example, floor tiles and roofing tiles were once formed by hand. They were often sun-dried or oven-cured and sustained variations as a result. Finishing surfaces was difficult, time-consuming, and limited, and therefore surface finishes may have had more variation. Likewise, color schemes may have varied due to the inability to match between batches the exact constituents of ingredients in a material, such as tile.

Thus, variations in texture, color, structure, shape, and the like they were natural in more primitive environments, are largely removed by modern technology. Similarly, a structure exposed to climatological variations and repetitions over years, centuries, or millennia would "grow" to reflect the conditions under which it existed.

In modern construction, much effort is put into providing a specific "look" desired by a user. A user may be thought of as the actual occupant of a home, office, restaurant, building or the like. Thus, a user is typically an owner, or one who by virtue of another lease or rental right is the occupier and user of a structure. Often a user will go to great lengths, time, money, examination, experimentation, and the like in order to provide a particular look. Brick is now provided with distressing. Brick may also be provided from the bottom of a kiln, where forces and temperatures have caused warping and misshapen lines. Thus, distressed or primitive appearances in brick are available.

Similarly, finish surfaces, whether of wood, plaster, or the like may be made using primitive tools, or techniques that mimic the marks of primitive tools, in order to provide a more primitive look. Wood surfaces may be distressed in order to provide an appearance of centuries of wear, from the first day of installation.

Tile has remained above, even aloof, from susceptibility to a change of its appearance. Accordingly, a new tile roof may be placed on a Tudor structure, or medieval Spanish structure, or medieval European structure, or the like. Similarly, a building may be constructed to fit any particular period of time, political environment, epoch of architectural design, or the like. Nevertheless, even if tile, an ancient solution to the roofing issue, is used, it will appear new on the day it is installed, and will require the requisite number of years in order to effect the same appearance of old or ancient construction, that may be achieved by the design of the underlying structure in the beginning. That is, an aged roof is simply not available.

It would be an advance in the art to provide a roofing tile or other cement-based (cementitious) substrate that can be characterized or given a new character by virtue of some process of manufacture.

For example, it would be an advance in the art to provide an ability to distribute a colony of lichens over a tile roof. It would also be an advance in the art to be able to provide the appearance of moss on a roof many years before it could naturally appear. Likewise, it would be an advance in the art to be able to provide an appearance of age and climatological results, in an area that is climatologically or geographically disparate from that appearance.

For example, if one wishes to provide a cottage having the appearance of a beachfront bungalow on Cape Cod, Mass. or Cannon Beach, Oreg., it cannot be done in Arizona. That is, the climatological conditions of an arid desert climate will never replicate the lichens and mosses that would grow on the Oregon coast, or the Massachusetts peninsula. Similarly, one will not achieve the appearance of the arid deserts in a location that has a high humidity.

It would be an advance in the art to provide design flexibility and control to a user, a builder, an architect, or a designer responsible for the exterior appearance of a structure. Accordingly, it would be an advance in the art to provide the ability to create permanent structures within or on a roofing tile that would give the appearance of age, climate, weathering, biota growth, or the like, on demand.

Moreover, an individual may decide to prepare a design plan for a structure incorporating the natural environment of a locale. Accordingly, woods, trees, foliage, colors, rocks, geology, geography, climate, and the like may all be considered in providing a structure that fits within its environment. That is, instead of providing a structure that is impossible to actually create by nature within an environment, one may choose to simply design a structure that will immediately have the appearance of aging, and exposure within its local environment.

Accordingly, a user, architect, builder, and so forth who have responsibility for selecting the colors and textures of the interior, exterior, or both of a structure may benefit greatly from the ability to instantly create a roofing tile having a color scheme, texture, and so forth as well as other underlying basic structural elements, concurrent with local environment. Accordingly, local rocks, tiles, trees, and the like may be consulted for disclosure of colors, textures, distribution, areal density, coverage fraction, concurrence between biota, and the like naturally occurring in a locale. Similarly, a look inconsistent with or impossible in a locale may be designed to fit a style of a structure.

Thus, what is needed is a method, apparatus, and system for creating a tile having an arbitrarily selectable scheme for shape, color, texture, and variegation of color scheme and texture as selected by a user, designer, architect, builder, or the like. Specifically, it would be a great advance in the art if a user could select a color scheme, appearance, or the like that could be created on demand to provide the finishing touches on the roof tile of a house or other structure.

BRIEF SUMMARY AND OBJECTS OF THE INVENTION

In accordance with the foregoing needs and requirements, applicants have developed a system, method, and apparatus for constructing and installing a roofing tile having an arbitrary design of color, patterns, textures, and the like in accordance with the requirements of a user, a designer, an architect, or the like. This system, method, apparatus, and resulting tile provides an ability to select a color scheme for a base tile, variegations within the color of the base tile, as well as accent medallions having color, textures, and the like. Moreover, a texture may be provided to improve adhesion of the accent medallions to the base tile. In alternative embodiments, no texturing is required, but may be provided simply as a design element affecting shading in varied lighting.

Moreover, an arbitrary, even random pattern of sizes, thicknesses, colors, distributions, areal densities, coverage fractions, and the like may be selected according to any pattern, a random assortment, or the like. Multiple layers of accent medallions may be applied in different colors, in any order selected. Accordingly, the appearance of lichens, moss, or other biota may be replicated on any selected surface of a tile.

Typically, medallions for accenting the colors and textures of a tile may be applied to a top surface (the principal weathering surface), or an end face at the foot of a tile. Although medallions may be applied at the head or on either side of a tile, such an application may interfere with proper fitting of the toe of an upper tile against the head of a lower tile.

Likewise, since tiles are interlocked with a finger protrusion extending into a gutter of a toe portion on opposing sides of adjacent tiles, accent medallions may best be applied, in most circumstances, to a region of the tile considered the exposed portion of the top surface, as well as to the end face or the face of the toe end of a tile. These locations coincide with the typical locations where lichens and mosses grow on a tile. Moreover, by layering medallions, accents in multiple colors may be made to overlay one another, thus providing a random appearance and yet an ordering of layers representative of the distribution of fungus with overlying algae in a typical lichen colony.

In certain embodiments, an apparatus and method in accordance with the invention may provide a method for decorating a cementitious substrate, such as a tile, floor tile, roofing tile, or the like. The method may include selecting a base color scheme for the substrate. Selecting at least one accent color scheme may involve selecting one or more colors for pigmenting medallions of color applied to the top of the substrate after formation of the substrate.

The method may include selecting a random orientation or selecting another orientation that is more regular, or an orientation that is pseudorandom for the extent, location, angle, arc, or a combination thereof characterizing texturing patterns to be brushed, gouged, scraped, or otherwise embedded within the base of the substrate. In certain embodiments, the method may include providing a substrate having a base color scheme. The color scheme for the base may include one or more colors that are integrated, not into a single color, but to variegate the color in the base material. In particular, the variegated color scheme is mixed throughout the substrate, and appears on a top surface thereof as well. In use as a roofing tile, the substrate will have a portion exposed to the elements of the weather, and a portion that is covered or unexposed, due to being overlapped by an adjacent tile thereabove.

The substrate may be textured along its top surface in accordance with the orientation and pattern selected for texturing. The texturing may serve to engage and secure accent materials applied to the top surface of the substrate, and across the texturing pattern.

Accent materials are added before curing of the material of the substrate in most instances. That is, typically, a cohesive bond is desired and desirable between the substrate and the accent color medallions. As a practical matter, the accent colors are applied in globules that may splatter to a greater or lesser extent to form irregular but somewhat circular medallion shapes having a distribution of sizes and locations, as well as spacings therebetween. Medallions are formed of a material providing a bonding ability with the substrate. Medallions may be applied based on paints, epoxies, other polymers, base material pigmented in contrasting colors, or the like. In one embodiment, the base material is a cementitious material including aggregate, cement, water, and pigments. Similarly, accents and substrates may include the same materials in proportions designed to provide the best performance for the substrate and accents, respectively.

The accents, and accent medallions in particular, may typically be applied prior to curing of the substrate. By applying accent medallions promptly after extrusion, molding, or other formation process creating the substrate, and prior to any substantial curing of the top surface thereof, a better cohesive bond may be formed between the accent medallions, and the binding materials such as cement or polymer therein, and the corresponding materials in the substrate. In certain embodiments, medallions maybe added to order and fired, baked, dried, or otherwise cured to bond to the substrate. That is, for example, a suitable, durable, epoxy or other polymeric accent may be added and function adequately. On the other hand, a cement-based material may be added as a medallion or accent bonding cohesively to the cement of the substrate.

By whichever mode constructed, the substrate or tile is typically cured. Curing may occur simultaneously for the substrate and the accent medallions. In an alternative embodiment, the substrate may be cured, and the medallion applied after curing. In yet another alternative, the substrate may be cured partially, such as by drying, as is done with clay materials, with the accent applied thereafter and both fired together for completion of cure. In one presently contemplated embodiment, the accent medallions and the substrate are both formed of cement, aggregate, water, and pigments, and may be formed in quick succession almost simultaneously, and cured together.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 3 is a schematic block diagram of one embodiment of a process for manufacturing artificially accented tiles for roofing or the like;

FIG. 6 is a schematic block diagram of one embodiment of a process and steps for providing accents in the process of FIG. 3 or the like;

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 16 is not intended to limit the scope of the invention, as claimed, but is merely representative of certain presently exemplified embodiments of the invention. The presently exemplified embodiments of the invention will be best understood by reference to the drawings, wherein like parts are designated by like numerals throughout.

Figure 1:
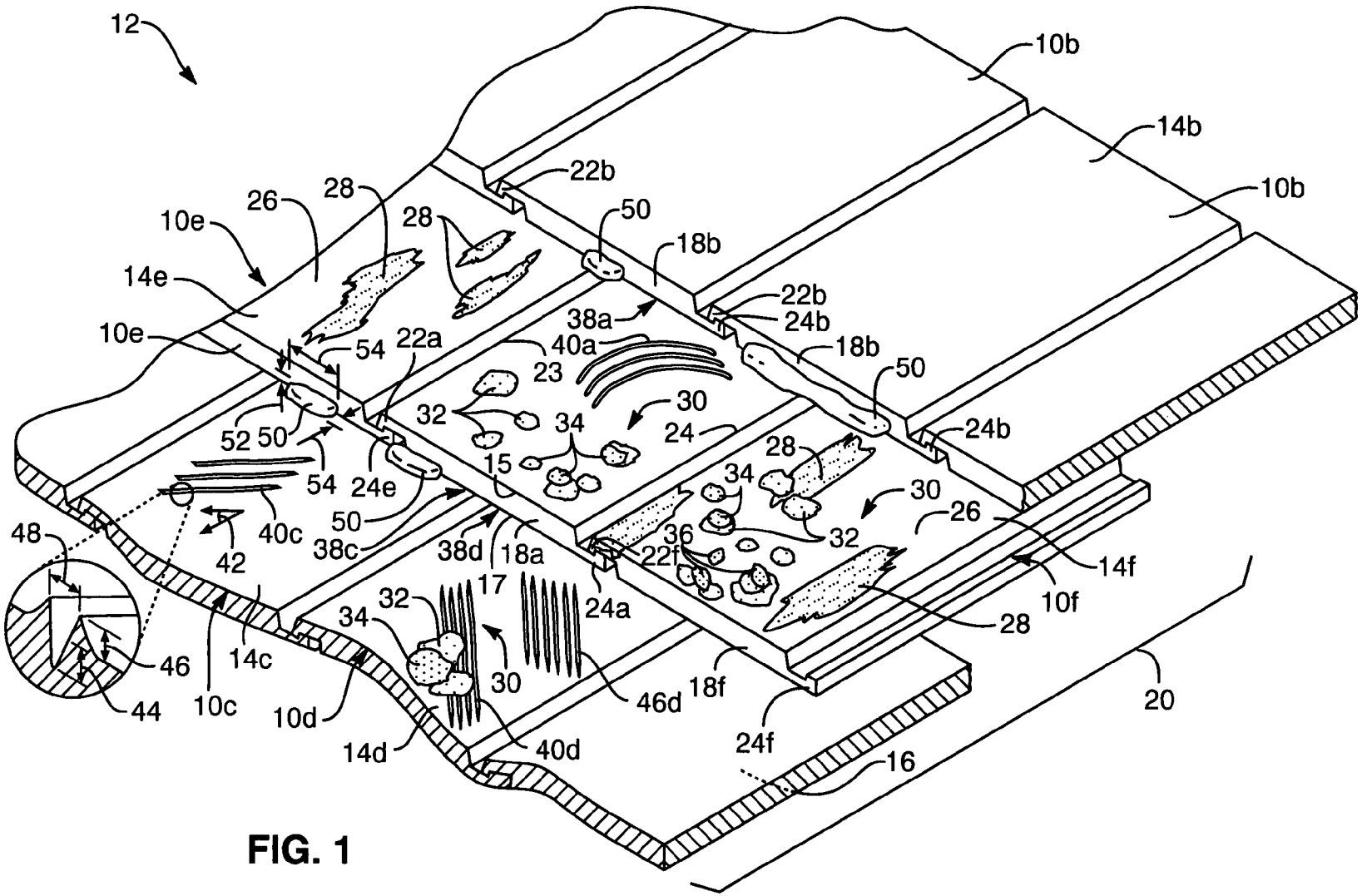
FIG. 1 is a perspective view of a tiled roof system illustrating various design elements available for application to roof tiles in order to provide accents thereto.

Referring to FIG. 1, an apparatus 10 may be formed as a tile, substrate, structure, or the like of a clay, or cementitious (aggregate, cement, water, and so forth) material that cures to a structural hardness having a degree of structural strength (compression, tension, bending, etc.). Cementitious and clay products typically provide less strength in tension than compression.

In typical embodiments of a substrate or base manufactured to serve as a roofing tile, a system of interlocks is typically provided on opposing sides in order to alternately shed and gutter water from the tiles. Accordingly, one tile sheds water onto another tile, or the gutter of another tile, so that each will shed water downward along a roof surface.

In conventional Spanish tiles, tiles may simply be semicircular in cross section as semicircular cylinders. Such an embodiment, an upside down tile may form a channel, and protruding from either side of the channeling tile will be two shedding tiles shedding water downward and laterally to their sides into the trough or guttering tile.

In alternative embodiments, in accordance with modern technology, a groove along one edge of a tile forms a toe portion or is bounded by the tile on one side and a projection on either side of a gutter, all forming a toe of the tile, with a finger made on the opposite side of the tile having an upward groove and a downward projection configured to fit within the gutter forming an overlapping end interlocking link. The link provides a mechanical link in order to align and set tiles, as well as providing guttering of any water arriving at the interface between two tiles.

In general, a tile 10 may be assembled into a system 12 of tiles to cover or provide a surface of a roof. In some embodiments, tiles are merely laid across purlins extending across rafters. In other embodiments, a roof deck is provided, with cleat extending thereacross at right angles to the downward slope of the roof. Accordingly, tiles may be supported on the cleats. In other embodiments, tiles are provided with cleats built into the underlying structure thereof so that they can be nailed directly to a roofing surface, and overlap with one another, without the need for other structure.

Tiles 10 may be formed in a variety of shapes. That is, hemispherical or semicircular, flat, angled, and the like. Modem technology has provided tiles in a substantially flat configuration that provides a maximum amount of coverage, a maximum size of tile to speed up the process of laying the tiles, and so forth.

Typically, a surface 14 on the top of the tile 10 provides the actual protection against the elements of climate and also supports the overlapping tile adjacent and above on the roof. One will notice in FIG. 1 and other figures the use of trailing letters behind certain reference numerals. The trailing letters merely reflect other instances of the same item identified by the reference number. Thus, for example, each of the individual tiles 10 (e.g. 10*a*-10*g*) is an instance of a tile 10.

In general, a surface 14 of a tile 10 will end at a lower or tail end with an edge 15. The edge 15 may be cleaned, broken, crooked, straight, or any variation capable of manufacture. In certain tiles 10 where a more primitive look is desired, the edge 15 may be far from straight along the top surface 14.

In general, for each tile 10, a surface 16 or bottom surface 16 sits in contact with a top surface 14 of an adjacent and higher tile 10. Thus, for example, the tiles 10*a*, 10*e*, 10*f* rest their lower surfaces 16 at a tail end thereof against the upper surfaces 14 at the head ends thereof of the tiles 10*c*, 10*d*. Likewise, the lower surfaces 16 or bottom surfaces 14 of the tiles 10*b* rest on the upper surfaces 16 of the tiles 10*a*, 10*e*, 10*f*. Nevertheless, the lower surface 16 is not necessarily planar, even in a flat tile. That is, for purposes of strength, weight savings, reinforcement, drainage, ventilation, and the like, a lower surface 16 may be shaped substantially different from the upper surface 14.

An edge 17 forms a boundary between the lower surface 16 and the face 18 or end 18 of each tile 10. Along the edge 17, as with the edge 15 bounding the top surface 14 and the face 18, the shape is selectable, and may be arbitrary. That is, the edges 15, 17, and, in fact, the entire face 18 may be ragged, jagged, curved, angled, arbitrarily configured, or the like, or may be a straight, rectangular element of the tile 10.

A tile 10 may include accents 20, either natural or artificial. In certain embodiments of an apparatus and method in accordance with the invention, accents 20 may be applied artificially during the manufacturing process of the tiles 10. Accents 20 may include any one or more of numerous features that provide a particular look for a tile. Tile has typically been formed by molding or extrusion to have a particular shape and a specific surface 14. The surface 14 may be flat, curved, ragged, grooved, striated, or the like. Nevertheless, the treatment of the surface 14 is typically done in a form that lends itself to production.

For example, linear striations along the length of a tile 10 are typically formed by shaping the die forming the surface 14. Thus, so long as a shape is linear and continuous along the length of a tile 10, then a die may produce such an extrusion. Similarly, so long as any element is restricted to a shape imprinted on the top of a tile 10, that shape can be imposed by a press, mold, or the like.

In general, accents 20 may be formed by a variety of processes. In an apparatus and method in accordance with the invention, accents 20 are produced by a number of new and novel methods in order to obtain a multitude of desired looks. One particular effect desired and accomplished by a method and apparatus in accordance with the invention is the texturing and coloration of regions of a tile 10, and of an entire system 12, effective to produce an arbitrary and selected appearance of age in accordance with specific color schemes or biota of interest to a designer, and specifically of interest to a user.

Each tile 10 may include a finger 22 or finger portion 22 that fits over and inserts into a toe 24 or toe portion 24 forming a channel for runoff. Typically, a finger 22 or toe 24 will be at one edge 23, and the other feature will be at the other edge 25, forming a continuous matching of mated portions 22, 24.

In general, a tile 10 may be formed as a base material. Typically a base material will have a base background 26. That is, the base background 26 is formed of a material or mixture of materials having a resulting color. In certain embodiments, the tile 10 may be formed to have a second color intermixed and integrated into the tile 10 as a base highlight 28. The base background 26 and base highlight 28 have different colors. The difference between the colors of the background 26 and highlight 28 may be slight or radical. That is, the degree of contrast may be selected by a user.

Moreover, the base background 26 and base highlight 28 may be integrated either grossly or finely. That is, the base highlight 28 is produced by cycling two separate feeds (e.g. auger, conveyor, etc.) into a single hopper feeding an extruder to extrude the tiles 10. Accordingly, cycling the feeds in an alternating operation where each color receives a comparatively long turn, produces a comparatively gross variegation of colors between the portions of the base highlight 28 and the base background 26. Alternately, cycling the feeds relatively rapidly between one another produces a comparatively finely integrated distribution of color between the base background 26 and the base highlight 28.

Likewise, cycling the feeds for the background 26 and highlight 28 for about the same equal portions of time will produce a comparatively evenly distributed background 26 and highlight 28. By cycling the highlight feed on a shorter operational time, or a shorter proportion of the time in each cycle, the background 26 will tend to dominate more, leaving the highlight 28 distributed in smaller portions and a smaller fraction of the overall total coloration of a tile 10.

In some embodiments, the base background 26 may be fed over a very long cycle that does not even integrate within but a single tile occurring periodically. That is, for example, the speed of cycling between or alternating between the feed for the base background 26 and the feed for the base highlight 28 may be extended for a long period of time this time may be sl long that the variegation of color between tiles dominated by the base background 26 and those other tiles dominated by base highlight 28, may actually vary only within an entire batch of tiles, or across a roof system, and not within a single tile.

Alternatively, the background 26 and highlight 28 may alternate within a single tile comparatively grossly or finely. Thus, integration of the highlight 28 and background 26 of a tile 10 may be finely integrated, grossly integrated, or super grossly integrated over a tile or series of multiple tiles.

Accents 20 include, in addition to variegations of the base highlight 28 within the base background 26, to include medallions 30. The medallions 30 may be formed of any suitable material that provides good cohesion or adhesion against the surface 14 of a tile 10. For example, durability of adhesion of materials is typically less if the materials do not form an integral cohesive bond.

In one instance, a cementitious tile 10 may benefit from a medallion 30 formed of a cementitious material having the same chemical constituents, whether or not in the exact same ratios. Thus, a concrete type of tile 10 formed of aggregate, Portland cement, pigment, and water may benefit from a medallion 30 formed of the same constituents, in a ratio appropriate to achieve the design characteristics desired for such a medallion 30. Nevertheless, medallions 30 may be formed of another material that provides good adhesion. For example, paints, glazes, epoxies, glasses, and so forth may be applied to a surface 14 of a tile 10 during manufacture in order to provide accented colors. Nevertheless, it has been found very suitable to use cohesion, wherein the same chemical bonds that bind the material of the tile 10 together also bind the medallions 30 to the tile10. A sealer may be applied over a finished tile 10 to protect the tile 10 for about two to three years so weather cannot interfere before a comparatively complete cure occurs.

In the illustrated embodiments, medallions 32 are formed of a material containing a first color or first pigment. Medallions 30 may be limited to medallions 32 of a single color. In an alternative embodiment, medallions 32 underlie medallions 34. Medallions 32 are formed of materials having a first color, whereas medallions 34 overlying the medallions 32 are formed of a second material having a second color. The first and second materials may be structurally the same as one another or different. They may be the same as or different that the base tile material 26.

In certain embodiments, a first color may be selected to be representative of one form of biota or other material adding coloration to a tile 10. For example, a color of gray may represent a fungus. Various shades of gray may be selected for a fungus. In certain embodiments, a single color may be used. In other embodiments, multiple shades of a color may be used. In one example, light, medium, and dark gray may all appear as colors selected for underlying medallions 32. One or more colors may be used for the underlying medallions 32. Typically, however, a single color is used, and is selected as a background color, such as, for example, the gray for fungus in a lichen colony.

Overlying medallions 34 are applied to the surface 14 of a tile 10 after the medallions 32 are applied. Thus, the medallions 34 may be located in a different place, but are often co-located over the same region where the medallions 32 exist. In nature, large colonies of fungus often extend over large fractions of a rock or tiled surface. In these colonies, it is not uncommon to find an alga growing on the fungus, but sometimes only in a particularly small fraction thereof and sometimes over a large fraction. Accordingly, the medallions 34 may be applied in a form to represent a distribution typical of algae.

In selected embodiments, additional medallions 36 may overlie medallions 34, medallions 32, or both. Any number of medallions 30 may be applied in any order, with any color desired. However, as a practical matter, the actual appearance of rocks and old tiles often reflects a lichen colony. A lichen colony includes a variety of fungus underlying a variety of algae. It is not uncommon to find different colors of algae growing symbiotically with a single field or region of fungus.

Thus, the medallions 32, 34 may both represent fungus, or may represent fungus and algae, respectively. Similarly, the overlying medallions 36 may represent algae or a single alga on fungus medallions 32, 34, or may represent one particular type of algae overlying a single or multiple color of medallion 32 shared with another overlying type of algae represented by the medallions 34.

Thus, one realizes that a designer or user may want to select a color scheme of particular interest, or of particular note in a locale. For example, a designer or user may observe the color schemes of local populations of lichens, algae, fungus, and the like and rely thereon in order to develop a color scheme for medallions 30.

At the joint 38 or interface 38 between a lower surface 16 of a tile 10 above, and an upper surface 14 of a tile 10 below, lichens may propagate. However, in certain environments, capillary action occurs in the region of the close proximity of the lower surface 16 of an upper tile, such as the tiles 10*a*, 10*e*, 10*f* against the upper surfaces 14 of lower tiles, such as the tiles 10*c*, 10*d*. This proximity provides a small reservoir of water periodically. Accordingly, mosses or crypto biotic plant life may propagate. In the presence of much water, mosses are typical. In the presence of only periodic water, a crypto biotic mass (algae, moss, etc.) may form.

Mosses may have a general color, such as a green, brown, yellow, or the like. Crypto biotic plant forms often appear so dark as to look black to an observer. Nevertheless, in the presence of plentiful water, crypto biotic plants typically expand, changing color, or color apparent, to an observer. Thus, a dark crypto biotic mass that would be interpreted as black by an observer may appear a brilliant or emerald green in the presence of water. Accordingly, an accent 20, such as a medallion 30 located near the joint 38 or interface 38 between two tiles (e.g. 10*a*, 10*d* or 10*e*, 10*c*, etc.) may be selected to have a color corresponding to a naturally occurring plant or other biota.

Along the top surfaces 14 of various tiles, texturing such as a rake, raking, striation, strokes, or the like may be formed in any suitable shape. It has been found that texturing 40 or strokes 40 may be produced on a regular basis or an irregular basis from tile 10 to tile 10. Initially, the strokes 40 or texturing 40 may be formed to provide more interfacing area, as well as shaping and texturing for securing medallions to the top surface 14. However, it has also been found that producing the texturing 40 or strokes 40 in a random and not regularly repeated orientation or extent from tile 10 to tile 10 produces an aesthetically pleasing result. Forming the strokes 40 or texturing 40 in any regular pattern, regardless of its shape, produces a regular appearance of shadow and texture on a roof system 12.

Designers and users find that a random or pseudorandom orientation 42 (think of an angle of a line or an angle of a tangent of a cure, taken with respect to any line or axis along a tile) may be selected for any given tile, and is pleasingly done if done at random or pseudorandom times. Likewise, the shape, whether arcuate or linear, may be changed and selected at random for a pleasing effect.

Typically, a stroke 40 or texturing 40 may be characterized by a depth 44 in addition to an orientation 42. Similarly, a height 46 of material above a nominal surface 14 of a tile 10 may also characterize a stroke 40. Thus, the actual total depth may be a combination of the depth 44 into a surface 14, as well as a height 46 of a boundary above the surface. That is, a height 46 is formed by the material gouged, scratched, raked, striated, etc. from within the depth 44. Likewise, a width 48 characterizes the individual strokes 40 or texturing 40. In certain embodiments, the texturing 40 may be performed by a hard or rigid (i.e. metal) tool. In other embodiments, a flexible brush, broom, bristle, plastic member, or the like may be used to form the strokes 40 in the surface 14 of the tiles 10.

In certain embodiments of an apparatus and method in accordance with the invention, tiles 10 may be provided with caps 50 as accents 20 secured to the face 18 or end 18 of a tile 10. The caps 50 may sometimes be referred to as fillets 50. As a practical matter, caps 50 provide additional texture and shadow patterns formed by the sun on a tile 10. Moreover, the caps 50 may be colored in any appropriate manner to represent naturally occurring or other coloration on a surface 14 of a tile 10. In certain embodiments, the caps 50 may be considered moss 50. That is, the location of the caps 50 as well as the appearance thereof may be selected to appear as moss or to give the appearance that moss would give in a tile system 12.

Accordingly, the caps 50 may be characterized by a height 52 by which each extends up the end 18, or upward toward the top surface 14 along the face 18 or end 18. Similarly, a thickness 54 that the cap 50 extends away from the face 18 or end 18 and along a top surface 14 of an adjoining tile may characterize caps 50. A width 56 along a joint 38 may be continuous, or segmented to a particular appropriate dimension.

That is, a width 56 of a cap 50 may be random set at a preselected value, or continuous. In certain embodiments, the height 52, thickness 54, and width 56 of any particular cap 50 may all be selected to have random values. Similarly, any characteristic of a medallion 30, or indeed any accent 20, including texturing 40 or strokes 40, and including base highlights 28 may be selected at random, or calculated to occur in a pseudorandom timing or spacing.

Figure 2:
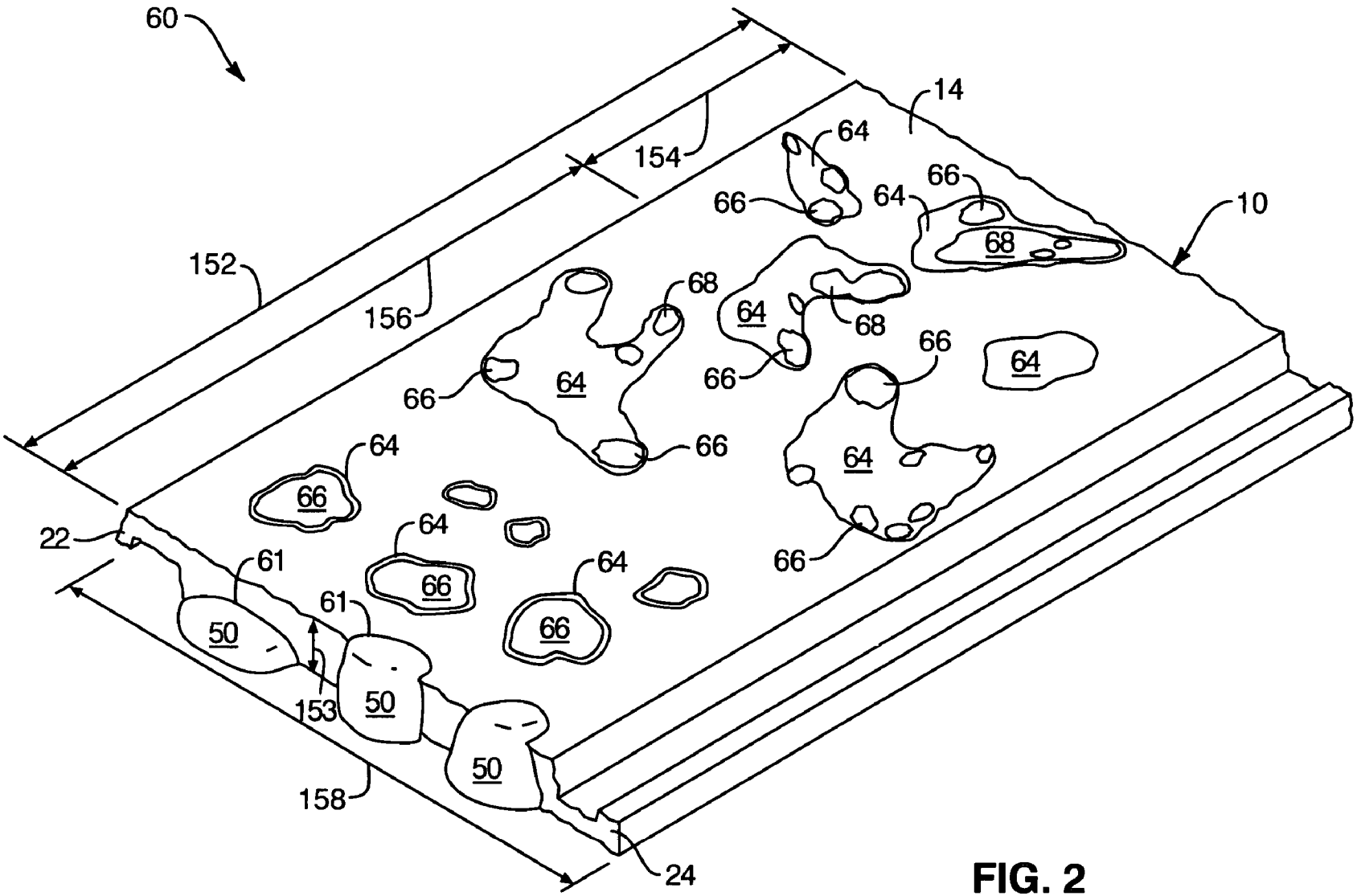
FIG. 2 is a perspective view of a single roof tile, having a distribution of accents, which accents may be provided naturally or which accents may be provided artificially during manufacture of the tile.

Referring to FIG. 2, a tile 10 may be formed to have an appearance that artificially mimics an appearance of a tile that has aged over many years. Typically, biota 60 populate a portion of an old tile 10 or rock. Included may be moss 61, lichens 62, and the like. Lichens 62 are comprised of a fungus 64 living in symbiotic relationship with an alga 66. Multiple algae 66, 68 may occur. The actual pattern of the biota 60 may be arbitrary, random, pseudorandom, or selected by a user. As a practical matter, the actual shapes of FIG. 2 were actually sketched from actual lichens and moss naturally occurring.

For example, one may note the fungus 64 may extend broadly and be dappled or of seemingly randomly populated by algae 66, 68 thereon. In certain embodiments, and in actual examples, certain algae 66 virtually completely cover the underlying fungus 64, as shown near the bottom of the tile 10 of FIG. 2. In such embodiments, the fungus 64 extends only as a rim having a gray color surrounding the algae 66 that have become almost completely coextensive therewith.

In certain embodiments, a specific pattern, shape, or the like may be imposed. That is, the medallions 30 or all accents 20 can be formed, marked, stenciled, or the like onto a tile 10, or on the top surface 14 thereof. In an alternative embodiment, the materials may be dropped by computer with size, color, shape, etc. controlled by a computer-controlled source thereof as tiles pass thereunder. That is, a particular pattern, whether regular, random, or pseudorandom may be applied as tiles pass under a computer-controlled system of nozzles, or the like, producing and applying accents 20 such as medallions 30, strokes 40, caps 50, and the like.

Alternatively, the accents 20 may be applied by a machine, operated at random. In an alternative embodiment, the accents 20 may be applied by a worker providing either a regular, random, or somewhat random assortment of accents 20. Thus, the medallions 30, strokes 40, and caps 50 may be applied in substantially any arbitrary configuration desired by a user, using either manual, mechanical, or computer-controlled and automated application techniques.

Figure 3:
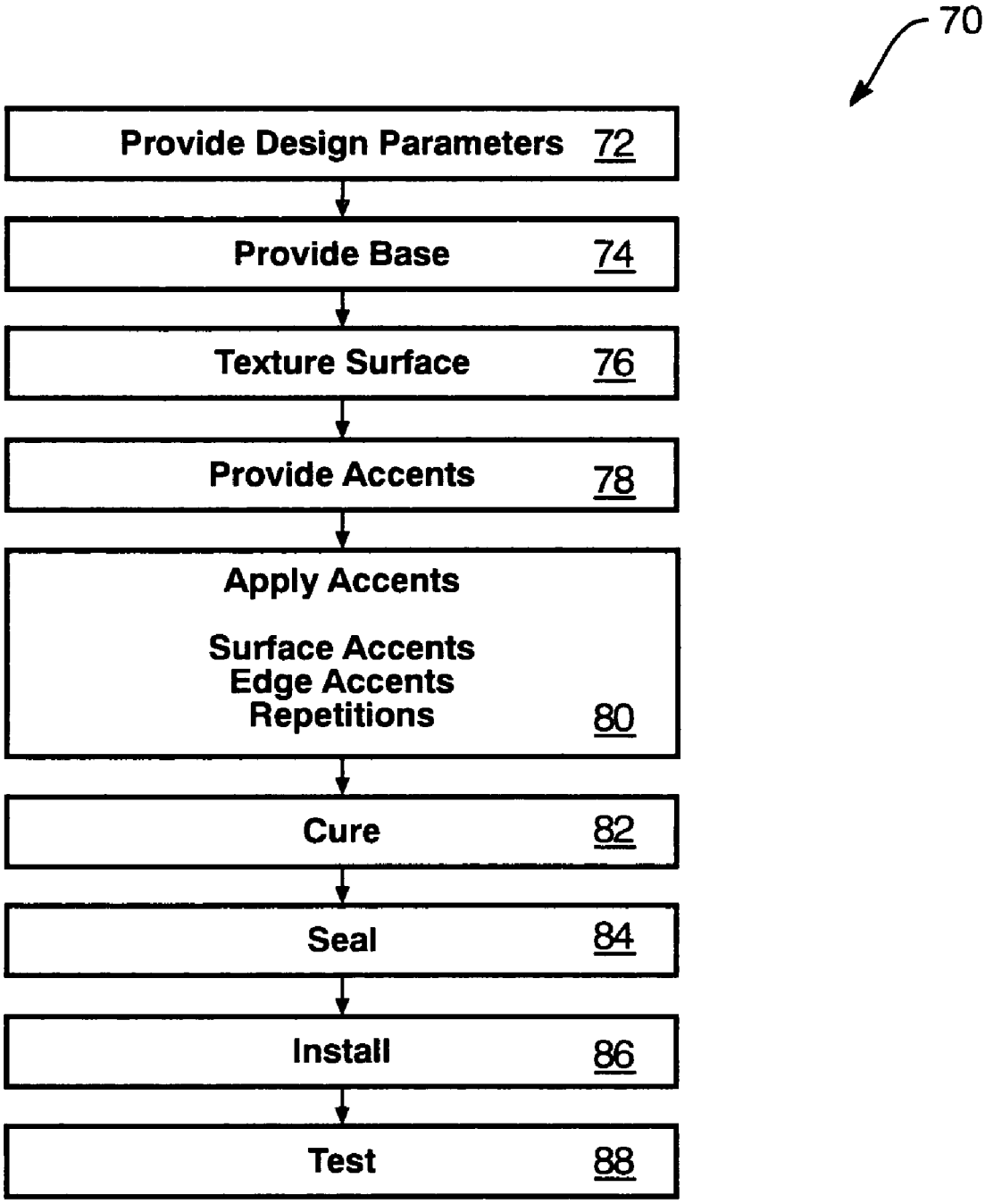

Referring to FIG. 3, a process 70 for manufacturing tiles 10 having one or more accents 20, including, for example, medallions 30 of color, strokes 40 or texturing 40, caps 50, or the like may initially provide for user inputs, or inputs from a designer, architect, or the like. For example, the process 70 may include providing 72 design parameters. Providing 72 design parameters may include identification by a user, designer, architect, or the like inputs, characterizations, facts, colors, textures, examples, photographs, pictures, or anything that may be used to communicate a sense of style, shape, color scheme, texture, or the like regarding tiles 10 or a roofing tile system 12. That is, an individual user may not be confident in the ability to design, a tile 10 or a system 12.

Nevertheless, a user may very likely have seen a roof 12 of interest. Similarly, a user may have an example of a tile 10 or other portions of a structure to be matched, copied, or the like. Accordingly, providing 72 parameters for the design of a tile 10 may come as a combination of a user or designer, providing the best communication they have and the best examples they have of characterizations of materials, such as appearances, styles, textures, shapes, measurements, colors, and the like to one who can translate these into parameters of use in the manufacture of a suitable tile 10 in accordance therewith.

Similarly, providing 74 a base may involve selection of various parameters and implementing those parameters and decisions in the compounding and fabrication of the base 10 or tile 10 to be accented. As a practical matter, color choices for the base may be made in the providing step 72 in which design parameters are outlined. For example, colors for a base background 26 and base highlights 28 may be determined in the providing step 72 in which design parameters are developed and provided for manufacture. By the same token, providing 74 a base may implement some of the parameters provided 72 with the design parameters, but will rely on much implementation details of a manufacturing operation.

Texturing 76 a surface 14 of a tile 10 will typically occur during the manufacturing process of providing 74 a base. Nevertheless, texturing 76 may be provided after manufacture, in the same manner that glazes and the like are provided. However, in certain presently contemplated embodiments, texturing 76 has been achieved most easily, and directly, and effectively by texturing 76 with the base 10 provided 74, almost immediately after extrusion thereof. In this way, the bonding agent (cement, or any other suitable material) is still fresh and uncured. Accordingly, cohesive or adhesive bonding of the base 10 to additional materials may be much more complete.

Similarly, texturing 76 in the uncured material of a base 10 can be done by simple mechanical, automated, or manual means. In some embodiments, providing 78 accents 20 may include texturing 76. In other embodiments, texturing 76 may stand alone as a process. It may be understood that texturing 76 may occur by a process compatible with providing 74 an uncured base 10, or by another method much later. For example, paints, epoxies, glazes, and the like may be added after an air-drying (partial cure) of a tile 10. By the convention of glazing techniques, this is adequate. However, if Portland cement is relied upon for bonding accents 20 of a concrete-like material, or the soft uncured material of the tile 10 is relied upon for raking 40 or stroking 40 to texture 76 the surface 14, then a wet, uncured base 10 is appropriate.

Providing 78 the accents 20 may include texturing 76. However, providing 78 the accents 20 typically includes one or more of texturing 76 and providing one or more colors of medallions 20. It may include providing one or more orientations and shapes of strokes 40 as part of the texturing 76 and to improve cohesion of the medallions 20 to the surface 14. It may include application of caps 50 to the ends 18 of the base 10 or tile 10. Providing 78 accents 20 may sometimes be thought of as both designing the accents and applying them. In an alternative embodiment, providing 78 the accents 20 may include the design process, where applying 80 the accents 20 is a subsequent or iterative process.

In one presently contemplated embodiment, providing 74 a base 10, texturing 76 a surface with strokes 40, and applying 80 accents 20 may all occur within a matter of seconds or minutes of one another. That is, an extrusion process may provide 74 a base 10 within a matter of seconds, from a cementitious, extruded material. Immediately thereafter, texturing 76 may provide strokes 40 in a shape, dimensions, and orientation. Immediately thereon to, or thereby on, the surface 14 of the tile 10 may be applied 80 accents 20 previously provided 78 or designed 78 to be applied. This entire process may occur within second or minutes.

Hours would pass in a much less desirable approach, since concrete cures slowly, but cures almost from the moment it becomes stationary. That is, concrete cures over a matter of years, and becomes harder with advancing years. Nevertheless, concrete cures to approximately seventy percent of its ultimate strength in a period of less than a month. An outer surface 14, 16 of a tile 10 may cure at a faster rate, being exposed to air. Likewise, any heating or drying that may occur in another environment may also increase the rate of curing. In order to improve cohesion of materials involved, accents 20 such as medallions 30 and a surface 14 of a freshly extruded tile 10 are best engaged as quickly as possible.

Applying 80 the various accents 20 may include surface accents 20 applied to a surface 14. Applying 80 various edge accents 20 (e.g. caps 50) to the end 18 may be included. Meanwhile, different colors, or even different materials, may be included in other repetitions. That is, multiple colors of accents 20 (e.g. medallions 30, caps 50) base highlights 18 may be applied. This may typically apply to medallions 30 only, but could conceivably also be allowed to occur for caps 50. Likewise, base highlights 28 may be printed or smeared instead of being extruded.

Curing 82 may involve heat, sun, or neither. For example, in certain embodiments, curing 82 is best done in an environment that does not excessively dry the outer surfaces 14, 16 of a newly extruded tile 10. Air drying may suffice, or simply time for completion of chemical reactions may need to pass.

In certain embodiments, sealing 84 may involve application of a polymer, silicone compound, glaze, or the like in order to seal a tile 10 against incursion of the elements. For example, rain may soak into a tile 10. For example, a tile 10, being made of concrete, may actually be of porous material and particularly susceptible to water, freezing, thawing, and the like. Although a seal does not last forever, it provides time for the curing 82 to continue after manufacture, and even after installation. Sealing 84 may be repeated years after installation, but is not necessarily done. Nevertheless, sealing 84 provides approximately two to three years' head start for a tile to become cured to a hardness more resistant to the elements of weather.

The purpose of tile 10 is usually to cover a surface, such as a floor, a wall, or a roof. In the case of a roofing tile 10, installation 86 may occur long after the tile has been designed and manufactured. In certain embodiments, the process 70 may be controlled by additional testing 88 to determine the steadfastness of bonds or simply the fastness of colors, the effects of bleaching by the sun, the effects of leaching by water and other elements of weather, and the like. The continuing benefit of sealing 84 may be evaluated in testing 88, as well as the cohesion of accents 20. For example, the survivability of the texturing 40, as well as the individual integrity and the bonding integrity of medallions 30 and caps 50 to a tile 10 may also be tested 88.

Figure 4:
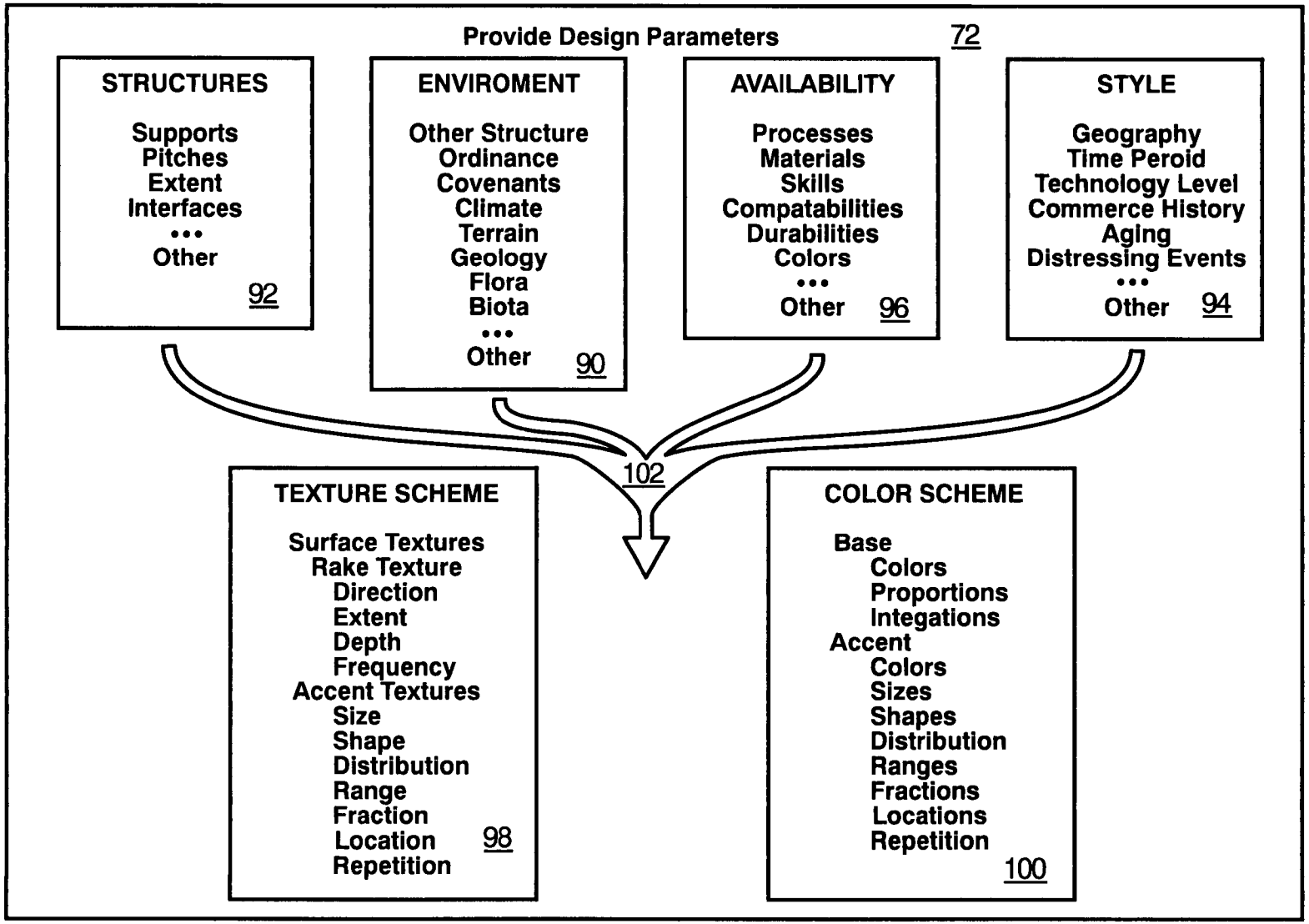
FIG. 4 is a schematic block diagram of various steps and processes for providing design parameters to the process of FIG. 3.

Referring to FIG. 4, providing 72 design parameters may include an iterative process. As a practical matter, a user, designer, architect, or other responsible party may consider environmental factors 90. For example, other structures embodied within, or in association with a roofing system 12 or a tile 10 may have an influence, or a need for compatibility.

For example, ordinances of a city may control what can be built, and what it can look like. Similarly, restrictive covenants may control the shapes and colors and overall style of a roof system 12 or a tile 10. Regardless of what other legal requirements may exist, climate, terrain, geology, and the like will have an influence. An individual user may decline to consider these factors, but may be bound, to a certain extent, to live with them in a particular area. On the same note, however, the appearance of a tile 10 may reflect a particular climate, terrain, or geology that is present in the area of use.

Alternatively, a tile 10 may be manufactured to reflect the effects of a climate, terrain, geology, or a combination thereof that does not actually exist at the location of use. Thus, one can build a structure that has a tile roof system 12 that appears to be that of a European renaissance structure. Such a building in the United States, such as in the arid southwest of Arizona or New Mexico, would be possible. However, it is not consistent with either local culture, or local climate, terrain, and geology.

On the other hand, an old California mission-style structure may be manufactured or constructed to have a roof system 12 with tiles 10 appearing to be four hundred years old. Such a look is consistent with the culture and climate, as well as the terrain and geology in California. Thus, one can select environmental factors to match the actual locale or to match some other locale.

Similarly, the flora of an area, as well as other biota (living organisms), such as lichens, moss, and the like of a region may be referenced for incorporation in the accents 20. Also, flora and other biota of a region distant from a particular locale may nevertheless be incorporated in accents 20. Thus, an architectural style may actually match, by the appearance of a roof system 12, both the period or epoch, as well as the age of a structure (that is, the apparent age).

Structures related to a roof system 12 may also be considered as structural factors 92. These may include various supports for the tiles 10, as well as the pitches of installation, the extent of the tiles 10 or the accents 20 within an individual tile 10, or within the overall roof system 12, as well as the interfaces of various structures with one another various design elements may all be considered as the influence structural factors 92 incorporated into design parameters provided 72 in the process of designing a roof system 12 and tiles 10 therefor. Other structural elements or structural factors 92 may be included as appropriate, and to the extent that one is aware of them, and able to either observe them or accommodate them, or the like.

Typically, an architect or designer desires to consider style factors 94, which often drive structural factors 92 to meet a style consideration 94. By the same token, structural factors 92 and style factors 94 are typically best used if consistent with one another. Style factors 94 may include the geography or physical location on the earth of a locale where a structure is to be installed. That is, a house or other building will be built in a particular location. That geography may be considered as a factor in providing 72 design parameters, or a geography may considered from a different area.

Similarly, the time period of either the style or the apparent construction of a building may be considered. Likewise, the technological level of a structure may be an important factor. That is, for example, there are places and times in the history of America, other countries, and the world wherein metal was comparatively difficult to come by. Under these circumstances, many structures for buildings were made completely of wood, and other non-metal materials. Similarly, tile made at certain times and places in the history of America, as well as in other countries, was a product of certain technological levels of manufacturing ability.

Accordingly, a material or a tile 10 may be, or simply appear, more primitive, even though made by modern technology, in order to provide a consistent appearance that would be typical of a different time period. Similarly, the technology level of any aspect of construction of a building or the roofing system 12 thereof, may accommodate that technology level as a design element. Likewise, the commercial history of a nation, region, or town may influence design parameters provided 72.

For example, at one time the West coast, California, of the United States had as much or more trade with China as with the East coast of the United States. That is, there was a time period in early and middle 1800s in which no transcontinental route existed for rapid shipment. Ships came around the horn of South America or the horn of Africa. A trip across the Pacific was actually faster and less cumbersome. Accordingly, Chinese commerce was very common on both the east coast and the west coast of America at one time. As in this example, commercial history may influence styles available at a place and time.

Other style factors 94 may include aging. For example, time passes and events occur. As aging progresses, colonies of lichens, mosses, and the like propagate and establish themselves at some rate and some density. That rate and density are dependant upon the locale. Accordingly, aging is a style factor 94 that may be considered in trying to match or mismatch a given locale. Another concern is durability. That is, certain features may or may not have been durable.

In addition to aging under the influence of naturally occurring conditions, such as weather and climate, a tile 10 may undergo events during manufacture or life. In furniture, cabinets, floor tiles, and the like, designers and architects, as well as users (homeowners, buyers, occupants) may request that marks corresponding to distressing events be placed thereon. For example, wood may distressed with nails, scratches, sanding, multiple coats of paint, with parts thereof sanded off, removed, applied with thinners and other materials to provide distress, and fixed in the distressed state.

By the same token, such distressing events may also be imposed upon tile 10 before it is actually sold. For example, during manufacture, distressing events such as cracks, chips, and the like may be applied to the soft uncured tiles 10. In general, stylistic factors 94 of any variety that is tolerated or accommodated by the manufacturing process for a tile 10 might be included in providing 72 design parameters for construction or manufacturing of a tile 10.

Other parameters that may be provided 72 in the design for manufacture of a tile 10 include availability factors 96. For example, just as a style factor 94 may be dictated by a time, place, political condition, technology level, civilization, or the like, availability factors 96 may influence what a tile 10 can look like, and still be consistent with other factors. Likewise, the availability factors 96 may also influence what will be appropriate with what else in the overall design of a tile 10 or a roofing system 12 made of tiles 10.

Availability factors 96 that may be considered in providing 72 design parameters may include processes available at the time period corresponding to the apparent age or epoch in which a tile 10 appears to have been made. Similarly, materials available may influence the color schemes, textures, and the like. Many naturally occurring materials are extremely characteristic in both texture and color, and may be identified as such. In addition, skill levels of workmen of a particular epoch may or may not have been available.

Similarly, different times at different locations within our country or any other country may influence the skills that were available for either manufacture or installation of tiles 10. Accordingly, evaluation and use of skills as availability factors 96 may help determine the ultimate appearance of a tile 10. By the same token, compatibilities either in appearance, color scheme, time period, technology, or the like may also be considered as availability factors 96. That is, to the extent that certain design elements were available for a structure, they may be consistent with or available to influence a tile 10. It is not always imperative that all materials and styles and other factors be consistent and compatible. Nevertheless, a careful designer is best able to provide a convincing and pleasant look desired by considering such compatibilities.

As a practical matter, availability factors 96 may be considered in at least two ways, old or ancient, and current. One may consider the availability of certain design elements or facts giving rise to design elements at a given time period in the past whose look is to be embodied in a tile 10 or roofing system 12 of tiles 10. By the same token, a builder of a modern building must consider current availability factors 96 in the actual construction of a building.

For example, to what extent are processes, materials, skills, compatibilities, and durability available in a particular locale? Likewise, to what extent are certain colors available. One may consider whether or not a color was available at a time period and in a locale, either that of a building, a structure of interest that the new building is mimicking, or the like. Current availability factors 96 are of somewhat less concern to Americans living in the continental United States due to the availability of shipping, storage, and the like. Nevertheless, to the extent that the process 70 for manufacturing tiles 10 is implemented in a particular location, both kinds of availability factors 96 may be considered to accommodate the realities of our modern time period as well as the look of an earlier time period after which the tile 10 is styled.

Ultimately, the various factors 90, 92, 94, 96 may be applied to providing 72 of a texture scheme 98 and a color scheme 100. Texture schemes may include surface textures. Similarly, rakes 40, textures 40, or strokes 40 may be considered. Direction, extent, depth, frequency within a single tile 10, or within a roof system 12 may all be considered when applying a rake 40 or stroke 40 texturing the tile 10.

Similarly, accent textures may include size, shape, and distribution. Distribution may include both an area covered, the sizes of medallions 30 in a distribution, or the like. Similarly, the range over which the medallions 30 will be distributed may also be considered. The fraction of coverage of an area may be considered in order to obtain a particular look.

Similarly, the geographical or climatic location has been a factor in both positioning medallions 30 and caps 50. Positioning may be selected by a user, designer, architect, or other party responsible in order to either mimic effect of a locale where a building is to be constructed, or to mimic another locale, after which it is styled. Similarly, repetition of any particular texture scheme 98 should be considered. That is, repetition too often in either direction, shape, color, frequency, or the like may give a regularity that defeats part of the purpose of attempting to mimic naturally occurring random processes in the life of a tile 10.

In reality, the texture scheme 98 and the color scheme 100 are not necessarily distinct from one another. That is, they are not necessarily separated or independent from another, nor distinct from one another in the decisions regarding them. That is, a base 10 or tile 10 may include both the colors, the proportions, and the fineness or grossness of the integration of the base background 26 and base highlights 28. As discussed above, the timing, frequency, dwell time on a particular color, cycle time, and proportions between the different colors, may all feed into the control of the appearance of a base 10 or tile 10 made of a base material.

Similarly, the accents 20, in particular the medallions 30 and the caps 50 may be considered for colors, sizes, shapes, distributions, ranges, coverage, fractions, clearances, locations, and repetition, just as the accent textures. As a practical matter, the color scheme 100 may actually be an adjunct, or something that is always done in correspondence with a texture scheme 98. That is, a particular color of medallion 30 may have a particular size, shape, color, height, and the like that are related to one another, and typically in combination.

Figure 5:
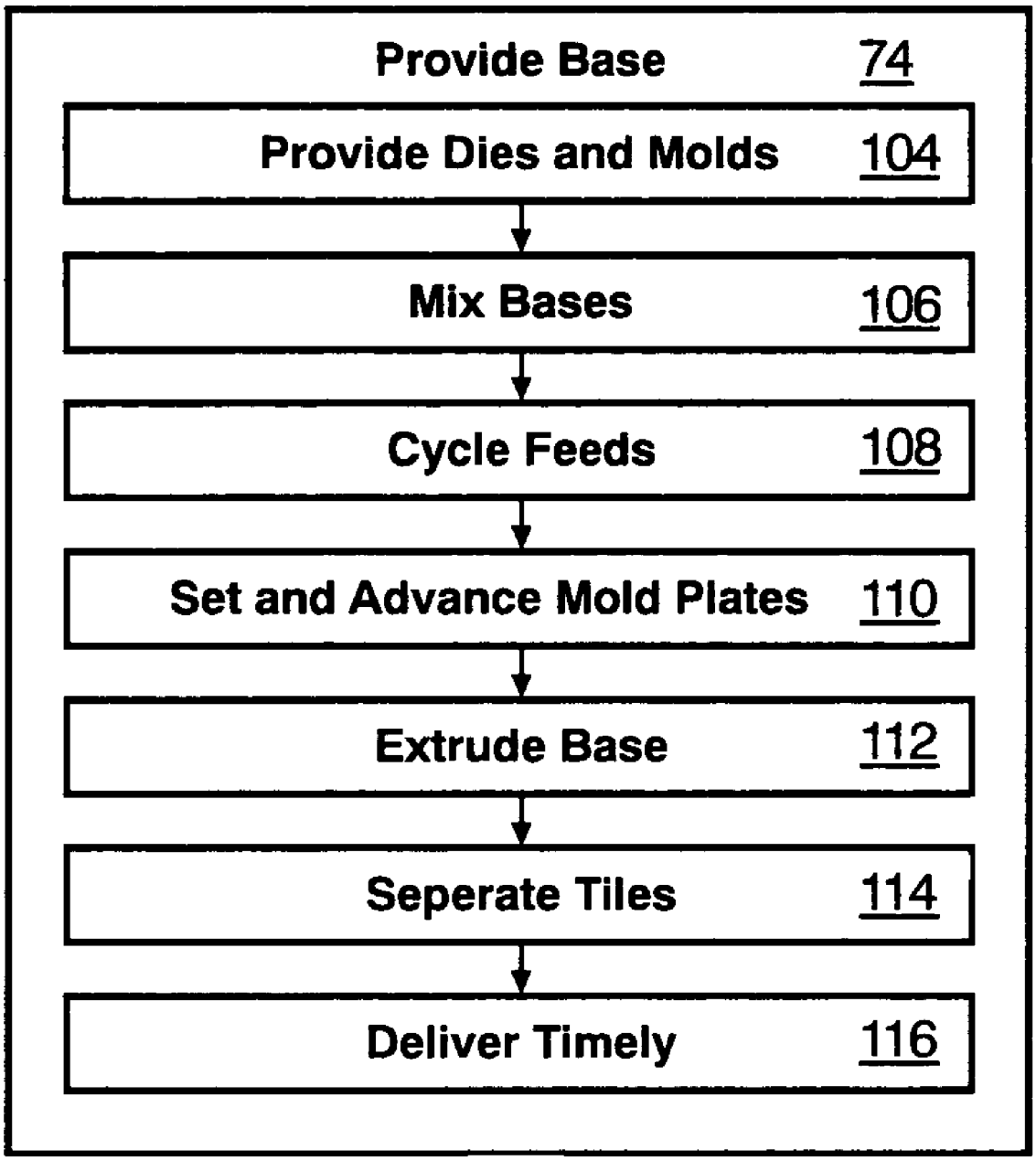
FIG. 5 is schematic block diagram of one embodiment of a process including steps for providing a base (tile, substrate, or the like) for inclusion in the process of FIG. 3.

Referring to FIG. 5, providing 74 a base 10 typically involves providing 104 dies, molds, or both. Molds are often used beneath tiles to shape the bottom surface of a tile, while a die shapes the extrusion of the top surface 11 along with the fingers 22 and toes 24 near the edges 23, 25 thereof. Mixing 106 the bases 10, or the base materials, is typically done in a particular fashion. Concrete tile 10 has particular ratios of constituents that work well. The principal constituents, which may be augmented by traces of other elements, typically include aggregate, cement, pigment, and water.

Aggregate may be large or small. For example, masonry sand is a particularly fine and regular sand. Masonry sand has been found effective for use in the mixing 106 of bases 10. By the same token, more random aggregate (e.g. small-size gravel, large-grit sand, and fine-grit sand) actually occurs in more primitive tiles, and may be used.

Similarly, Portland cement is a typical cement used, although others, including polymers, may conceivably be used. Likewise, pigments have various degrees of fastness, ease of use, cost, and the like. Accordingly, pigments may be selected for economy, color integrity, color choice, or the like.

Water content may be selected in order to provide a proper slump, identified as the ability to resist motion or the flowing characteristic of concrete. Zero slump implies that a particular mix of concrete once set in place, does not fall under its own weight. More water, less aggregate, and the like, are factors that may alter (decrease) the slump of concrete.

Cycling 108 the feed systems with the base background 26, and the base highlight 28 materials will be executed in manufacture. The cycling 108 should be in accordance with the planned design in order to provide the proper fractions, distributions, and integration of the base highlight 28 with respect to the base background 26.

Cycling 108 the feeds may involve operation of conveyors, augers, or other transport mechanisms. In certain embodiments, cycling 108 involves the timed delay and operation of augers moving a particular material to a hopper, from which hopper the extrusion process is fed.

Providing 74 a base 10 or a tile 10 may involve setting and advancing mold plates. In one embodiment, a conveyor system, such as a chain, belt, or the like, engages mold plates that establish the bottom surface 16 of each tile 10. Accordingly, the plates are installed or set according to the shape of the lower surface 16 of a tile 10. Accordingly, whatever the driving mechanism or conveyor system is, it advances the mold plates into an extrusion system. The extrusion system will be responsible for providing the top surface 14.

Extruding 112 the base typically involves the passage of molding plates through an extruder with the base material 26 and base highlight 28 captured between the mold plate below the tile 10, and the top surface 14 to be formed by the extruder. Accordingly, all the material that passes through on the mold plate, and is not sheared off by the extrusion die, becomes part of the base 10 extruded 112.

Molding may be done in many fashions, including molding directly into a mold cavity, forming by rubber molds under or above, or both with respect to a tile 10 under construction, and the like. Continuous or batch molding may be done using fixed or continuous molds, respectively.

Separating 114 tiles may be done in a variety of ways. In some embodiments, tiles may be cut cleanly. In other cases, tiles may be cut raggedly. In other embodiments, tiles may be roughly torn with a simple restraint such as several fingers penetrating near one end of a tile 10, while the separation of the mold plates rips the remainder of the tile 10 away from its adjacent tile 10. Accordingly, separately 114 in various ways provides a great degree of difference in the appearance, particularly on the end 18 or end face 18 of each tile 10.

Delivery 116 in a timely fashion may be extremely important in certain embodiments. If a cohesive bond between the same basic material (e.g. cement) in a medallion 30 and a base tile 10 is desired, then timely delivery may be a matter of seconds away from application of medallions 30. Similarly, delivery 116 may need to occur before significant surface curing occurs in a particularly dry or warm environment. Accordingly, timing of delivery 116 may be selected or identified by experiment, calculation, or other means, in order to provide 74 a base tile 10 that is ready and capable of receiving accents 20 as designed.

Figure 6:
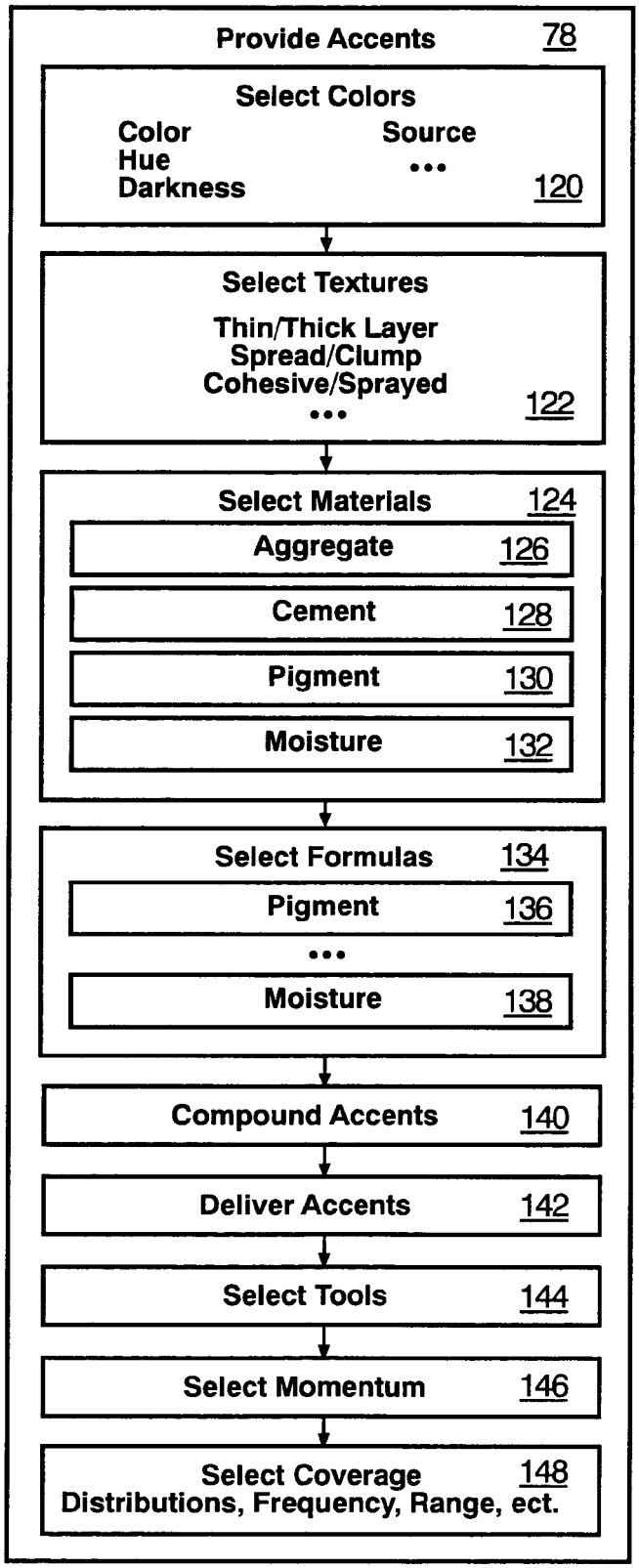

Referring to FIG. 6, providing 78 accents 20 may involve or not involve providing strokes 40 or texturing 40. In the illustrative embodiment of FIG. 6, providing 78 the accents embodies the design of the accents 20, rather than the actual application 80 of accents. That is, application 80 of accents 20 may typically follow the design and manufacturing process developed in providing 78 accents.

Providing 78 the accents 20 may be thought of as designing the accents 20. It may also be contemplated as including designing the process for application 80 of accents 20. That is, design of decorative patterns, the design of a manufacturing system, and the design of a manufacturing process to manufacture in accordance with that system are not isolated and independent events. Accordingly, providing 78 accents 20 may be thought of as providing the design of shapes, colors, and other design elements, as well as providing manufacturing processes for implementing 80 those accents 20.

Providing 78 accents 20 may include selecting 120 colors, selecting 122 textures, selecting 124 materials, selecting 134 the formulas, and compounding 140 the accents. Moreover, compounding 140 may be followed directly by delivering 142 batches of materials for implementing accents. Similarly, selecting 144 the tools in order to be able to apply 80 the accents 20 may be a critical, or optional, step depending on the embodiment. For example, selecting 144 the tools for providing strokes 40 or texturing 40 will be very different from the process of selecting 144 the tools for application of medallions 30.

On one hand, strokes 40 may actually be implemented by a mold or press type of operation, or by the stroke of a brush or other tool. By contrast, application of medallions 30 may occur by brushing, spraying, nozzling, stenciling, or the like.

Selecting 146 the momentum to be implemented with accents 20 may govern both the medallions 30 and the strokes 40. Momentum may be narrowed to force in some circumstances, such as in providing a gauged, gouging action by a tool applying a certain amount of force across a certain distance, at a certain depth. By the same token, the momentum of a brush may be implemented by a machine, or the approximate momentum of a brush may be implemented by a laborer applying brush strokes 40 to a tile 10, or the top surface 14 thereon.

Likewise, the momentum selected 146 for a brush, sponge, spray nozzle, carrier, or the like applying medallions 30 may likewise have a momentum that involves mechanical speeds and motions, or may involve the momentum of a flow or stream being applied. Similarly, the simple motions of setting a shield (stencil) and rolling an applicator thereover may replace or take the place of selecting 146 momentum. However, in certain embodiments currently contemplated, selecting an approximate momentum recognizable by a manufacturing laborer may be accomplished by either the laborer himself or herself, selected by a machine, or established by a designer and communicated to one actually performing the application of accents 20.

Selecting 148 the coverage of accents 20 may be a very creative enterprise, and may involve much trial and error. For example, the range over which accents 20 of any particular type are to be spread, the spacing therebetween, the size, the distribution of sizes, the frequency of medallions 30, strokes 40, or caps 50 within a tile, or from tile-to-tile in the roofing system 20 may all be determined by selecting 148 the coverage of accents 20.

It should be remembered that selecting 148 coverage may be subject to a very deterministic and rigidly fixed control. That is, a computer may actually control nozzles, rollers, screeds, other tools, brushes, and the like to apply texturing 40, medallions 30, and caps 50. By the same token, a laborer may simply approximate a template. A template may be a photographic, schematic, or physical sample used as an example. Thus, selecting 148 coverage, and actually implementing that coverage during the application 80 of accents 20, may be equally controllable, or completely unequally controllable. That is, a look may be approached, and may be matched more or less, by an artist or a laborer. By the same token, a look may be specified, calculated, and implemented by a computer-controlled machine.

In selecting 120 colors for accents 20, the individual color class, such as red, green, brown, yellow, etc. may be selected as well as a particular intensity, darkness, or shade. Similarly, the hue, involving the color content and mixture with other colors may be considered. In certain embodiments, the source of colors may be considered. For example, certain materials age differently and provide different durability of color or fastness of color. Similarly, sources may also alter with mixture. That is, certain colors may vary due to chemical reactions or other effects such as drying versus moisture, and the like. Accordingly, the source of color may be considered in selecting colors in a color scheme for accents 20. Textures may vary in both the thinness or thickness thereof, as well as the abruptness of the edge between a lower layer, such as a substrate or previous medallion 30, and the outermost surface of a medallion 30. Similarly, the amount of cement and subsequent tendency of the materials forming medallions 30 to spread, or clump, may be considered. In certain embodiments, polymers may be added in order to provide more stickiness or more tendency of the material to clump together when ejected, sprayed, thrown, or otherwise applied.

Similarly, the tendency to spread or clump once impacting a substrate may also be considered and configured b choice of moisture amount, cements, and aggregate as desired. In certain embodiments, cementitious materials have substantially no cohesive capability prior to curing, except that provided by surface tension of the water content. In other embodiments, the actual polymer chains of included polymer materials may actually influence cohesiveness before and after impact. Accordingly, a balance of the momentum, the mass, the mean particle size, and the cured and uncured cohesiveness may also be considered in selecting and designing textures for the accents 20, and particularly the medallions 30.

In certain embodiments, the material for medallions 30 as accents 20 may be compounded 140 according to the tool that will be used for application. For example, in selecting 144 a tool, one may consider a brush, scoop, spatula, screed, spoon, broom, hand, pegs, rake, comb, or the like. Accordingly, compounding 140 may accommodate the tool by selecting a viscosity, a surface tension for the liquid constituent, and other factors related to the cohesion of droplets or globules of material applied to a substrate, as well as the behavior of that material in forming medallions 30 once applied thereto, such as by impact, stenciling, painting, brushing, daubing, nozzling, or the like onto the surface 14 of the substrate 10.

In considering the selection 146 of momentum (e.g. mass times velocity), the amount of material to be applied as accents, droplet sizes, viscosity, slump, the direction in which applied, the orientation of the substrate (e.g. vertical, horizontal, incline, etc.), and the path taken by the droplets or globules of material may be factors considered. In stenciling, substantially no momentum is required. That is, material is basically painted onto a surface through a stencil. In other embodiments, material may be daubed or flung by hand, or splattered from a machine or hand tool, such as a brush, bristle, or the like, toward the substrate 10. Accordingly, the substrate 10 stops the trajectory of the globules of accents 20 causing them to spread, and even conjoin in some instances, along the surface 14 of the tile 10 or other substrate 10.

In selecting 148 the coverage, the range of coverage may be controlled or dictated to a certain extent to remain within the mechanical constraints of a tile application. For example, if a wall, bridge abutment, or the like is being decorated, then the boundaries of the object may be the boundaries of the range of coverage. However, with tiles 10, where a portion is covered and a portion is exposed, there is no need to apply medallions 30 as accents 20 in locations that are ultimately to be covered by another tile 10.

Another consideration is the distribution of globules, both in size, and location. For example, many small globules produce one effect, many large globules produce another. Similarly, a distribution of large and small globules may provide yet another effect. Similarly, the distribution from tile 10 to tile 10 of a particular color, size, or the like of globule may affect the overall appearance of the medallions 30 as accents 20 on a roof system 12 once installed.

Accordingly, a range of coverage may include a certain portion of a tile 10, but may not include every tile 10 in certain embodiments. Thus, a frequency, or the like, may be imposed on any particular parameter. That is, control may be exercised over how often a value of any factor or feature repeats in the overall pattern of the roof system 12, or within a particular tile 10, or from one tile 10 to another tile 10. In certain embodiments, a frequency is actually avoided. That is, in order to provide pseudorandomness, a frequency may actually never be established, but rather avoided. Thus, many events of a particular type may occur in manufacture, followed by a dearth of such events. Over the entire application of tiles 10 to a roof, for example, the overall appearance may avoid any observable pattern.

Another decision in selecting 148 coverage is the extent to which one color of medallion 30 may cover another color of medallion. In certain embodiments, in order to obtain the most decorative effect for the least amount of material used, a user may elect to have no overlapping. That is, a user may select to have colors located somewhat independently from one another. On the other hand, colors may be ordered in such a way as to provide an effect like that of the symbiotic lichen colony.

Another issue in selecting 148 coverage is the extent to which medallions 30 may cover surface strokes 40 used in texturing. In certain embodiments, the strokes 40 are considered to be a mechanical link encouraging bonding of medallions 30 to the substrate 10. In these embodiments, and in other embodiments, the textures of strokes 40 may actually be accents 20 themselves. Accordingly, brush strokes 40 or other texturing 40 may be applied to extend beyond the application of medallions 30, may be located to underlie the medallions 30, or may do both.

Obtaining actual randomness is sometimes difficult. People tend to operate with a certain periodicity to their actions. Accordingly, in certain embodiments, a pseudorandom calculation may be done by a computer in order to control application of accents. In other embodiments, a proportion of one particular accent 20 to another 20 may be suggested or directed. Nevertheless, in one embodiment, the stacking pattern for stacking tiles in a rack for curing is itself another method for rearranging the order of particular events, occurrences, or features (accents 20) available on the tiles 10.

In some embodiments, no hard and fast rule need be applied. That is, a certain amount of artistic license may be delegated to the worker responsible to apply accents 20. Accordingly, information may be fed back to a worker by way of a template, example, or commentary on appearance, measurement, or calculation of particular factors such as distribution, medallion effective diameters, color schemes, and the preponderance of any particular element.

Figure 7:
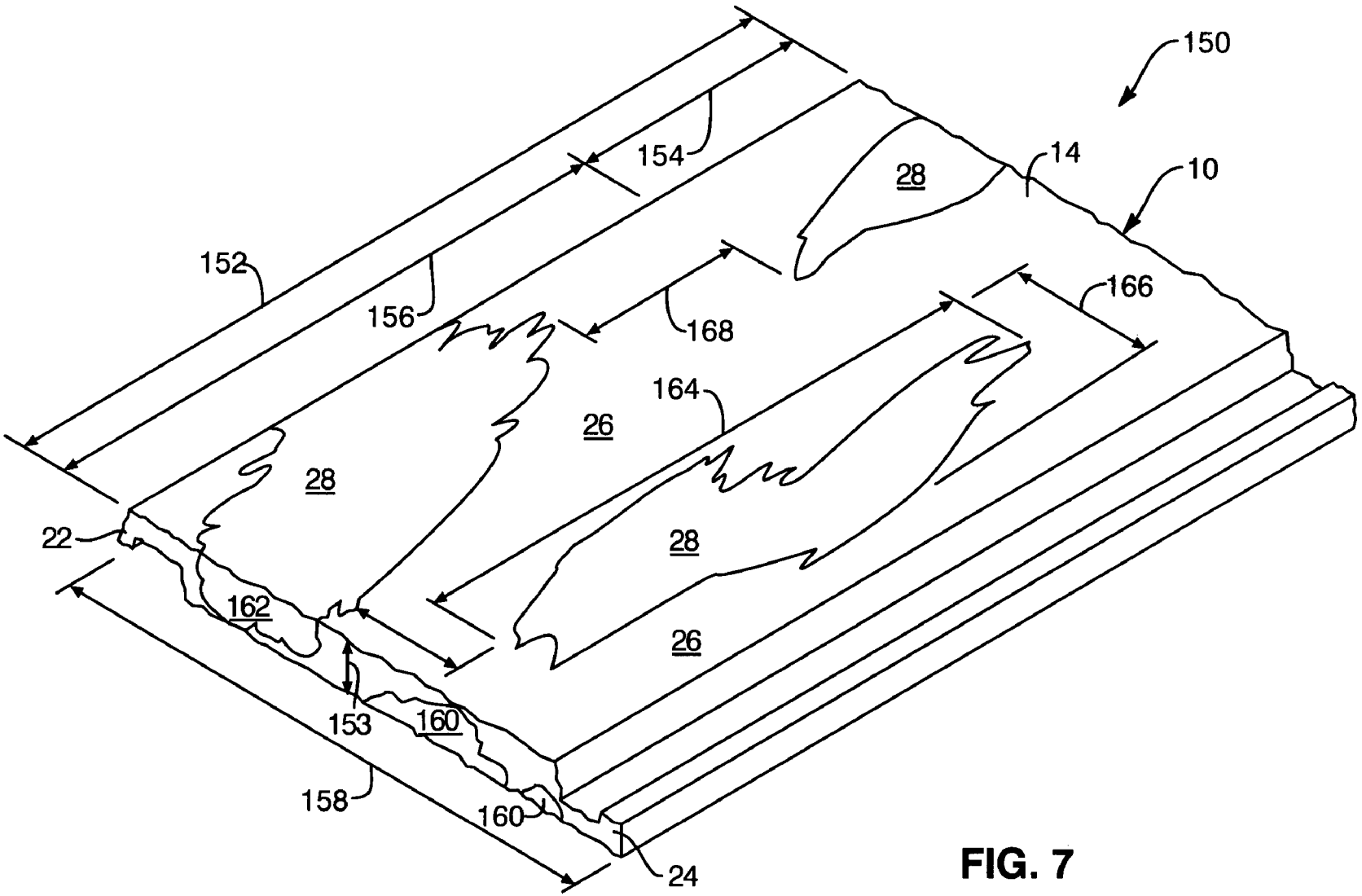
FIG. 7 is a perspective view of a tile in one embodiment of a process and apparatus providing gross integration of multiple colors of base material.
Figure 8:
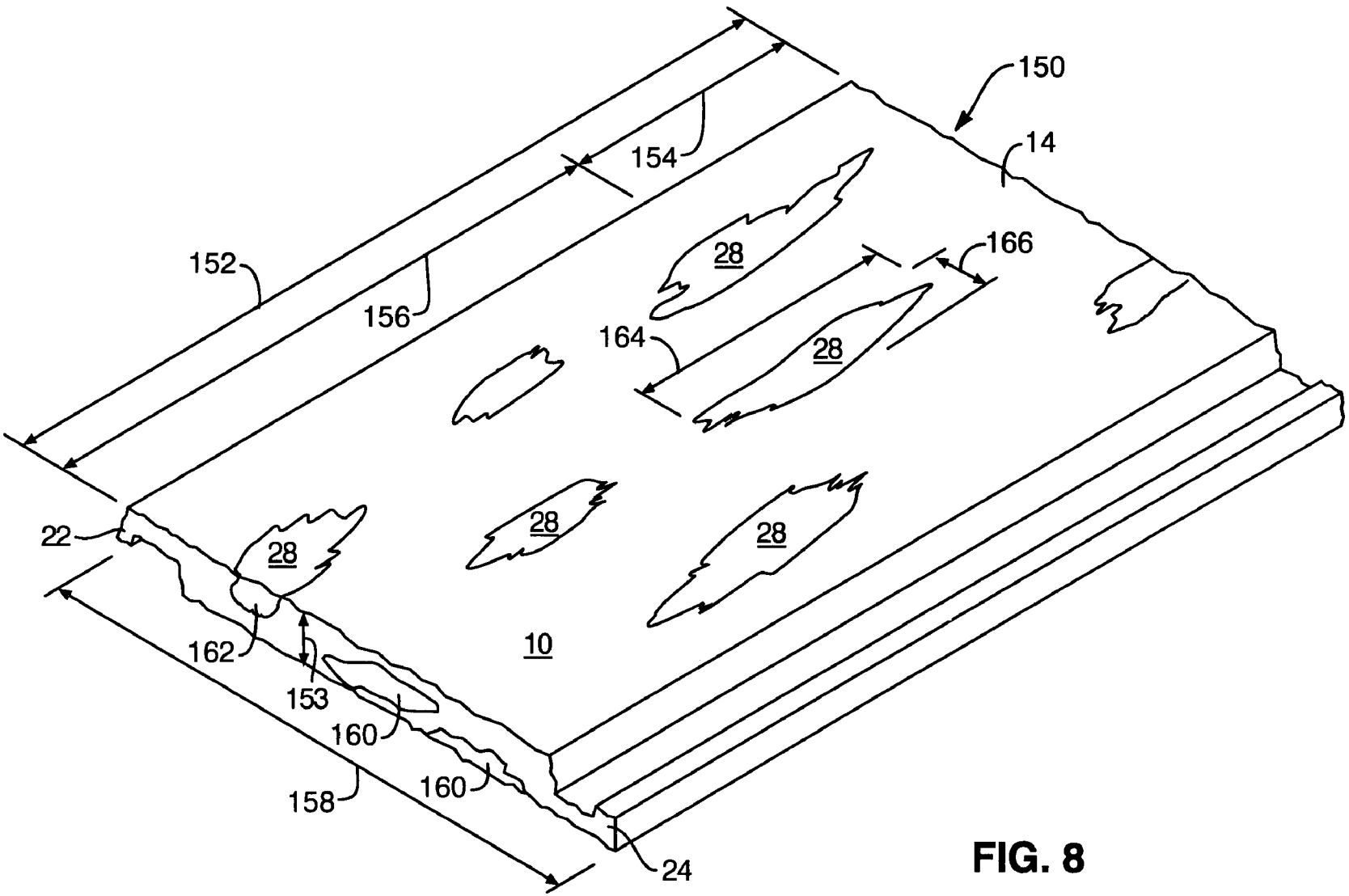
FIG. 8 is a perspective view of one embodiment of a tile or other substrate base made in accordance with an apparatus and method in accordance with the invention to provide a fine integration of multiple colors of base material in a substrate or tile.

Referring to FIGS. 7-8, a tile 10 or substrate 10 may be formed as a variegated tile 150. Variegations may be gross or fine in their integration. That is, a tile 10 may include a base background 26, as well as a base highlight 28. Due to the extrusion process, the base highlight 28 as well as the material in the base background 26 may smear together at the surface 14.

Moreover, since pigment may be added to the entire material of the tile 150, then the color of the base highlight 28, as well as the color in the base background 26 may extend throughout the thickness 153 of a tile 10, 150. Thus, along the length 152 of a tile 10 a certain portion may be a covered length 154, while another portion 156 may be an exposed length 156 or exposed region 156. The covered region 154 (covered length 154) is that portion of the tile 10 that will eventually be covered by an adjacent tile thereabove. Similarly, the base highlight 28 may extend across the width 158 of the tile 10, in the color scheme of the base background 26.

Since extrusion is one presently preferred method of construction of tiles 10, the variegated tile 150 may include a gross integration varying from a comparatively large fraction of base highlight 28 to a sufficiently large fraction to actually make the base background 26 such only by name or color. That is, for example, any ratio may be selected for the ratio of base background 26 to base highlight 28. In the illustrated embodiment, the base highlight 28 represents only about twenty-five percent of the overall material of the tile 150. On the other hand, the same fraction of base highlight 28 may be used, but simply broken into smaller portions, as shown in the fine integration of FIG. 8. The proportions of base highlight 28 to the amount of base background 26 may be changed to substantially any ratio, and the illustrated embodiments are only representative. That is, the principal of fineness versus grossness has to do with the relative sizes of chunks or globs of the base highlight 28, not the total fraction.

In a super-gross variegation of the tile 150, entire tiles may be almost totally formed of one material. The variegations between base highlight 28 with respect to base background 26 may actually occur only over a few tiles, or over a single tile, while one color or the other dominates or operates exclusively to color the adjacently formed tiles 150. Fine integration of variegation provides a substantially uniform appearance, much as the dots in a lithograph, although having different colors, appear to the resolution of the eye to be a single mixed color. On a roof system 12, fine integrations such as those illustrated in FIG. 8 may actually appear to be tiles 150 of uniform color. The gross variegations of FIG. 7 are more observable by a user. Super-gross variegations could provide a more broadly sweeping variegation in which color variations are observable to a user throughout a roof system 12.

Since colors are typically mixed into the material forming the base background 26 and the base highlight 28, imbedded highlights 160 may exist, but are unseen. On the other hand, a deep highlight 162 may extend down into a tile 150, yet be visible at the surface or on the surface 14. Each base highlight 28 may be characterized by a length, whether selected to be maximum length, mean length, a weighted length based upon distribution and "moment" concepts of area and distance, or the like.

Similarly, the base highlights 28 may be characterized by widths 166 as well as lengths 164. Similarly, clearance 168 or distance 168 longitudinally between base highlights 28 may be measurable, and use to characterize a style, appearance, or manufacturing control parameter. A clearance 169 or distance 169 laterally across or between base highlights 28 may be characterized by a maximum value, minimum value, or mean value, either as between two highlights 28, or as between all highlights in general. Accordingly, certain design parameters may eventually be measured, calculated, or controlled in order to produce a desired effect. If a designer, user, architect, or the like determines that a particular look is desirable, the characteristics embodied in that particular set 12 of tiles 150 can be measured in order to determine exactly what has contributed thereto. Thus, the ability to reproduce a particular appearance may be fostered. By the same token, a certain irreproducible randomness may also be embodied if desired and as desired.

Figure 9:
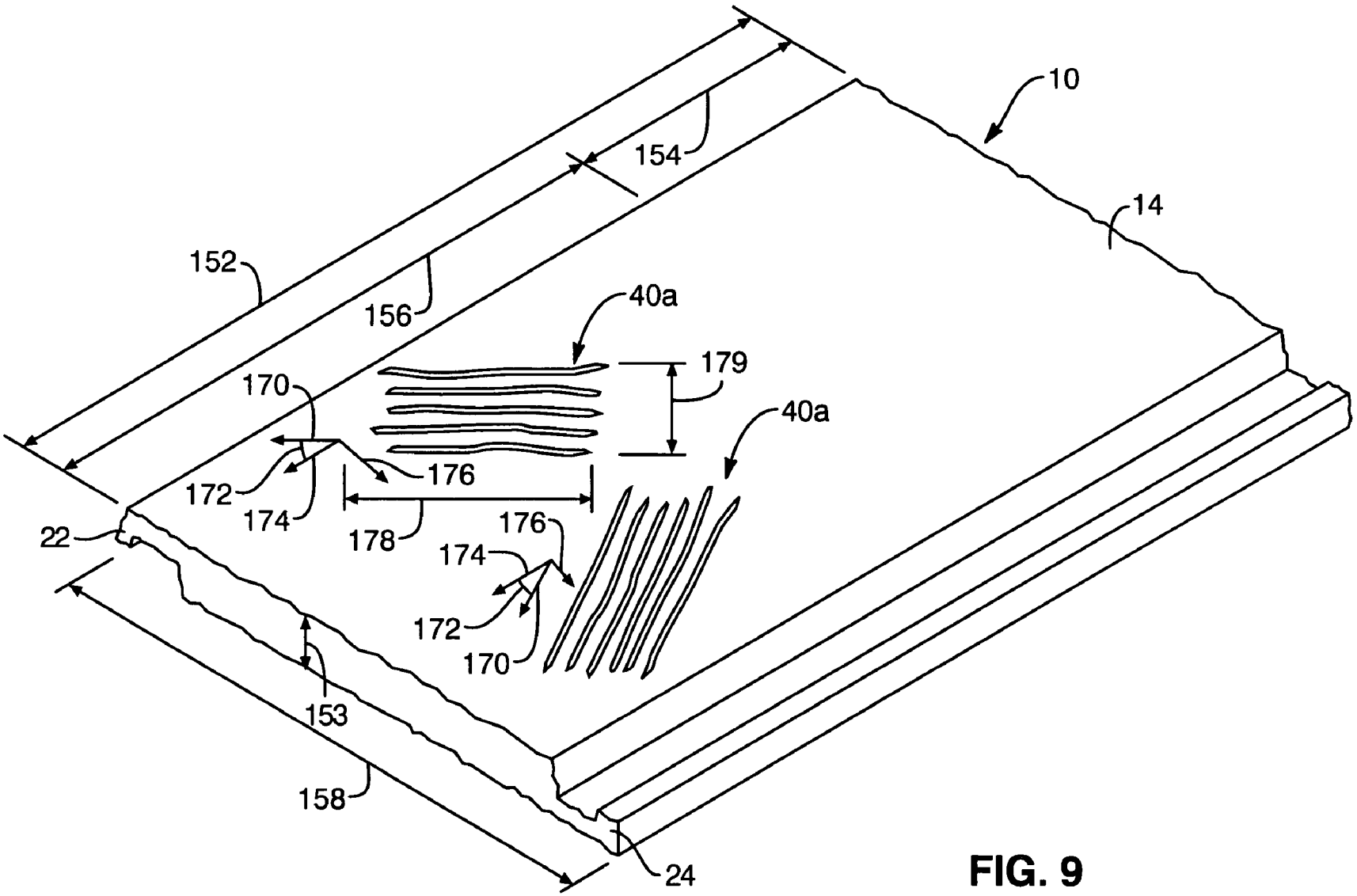
FIG. 9 is a perspective view of one embodiment of a substrate or tile made in accordance with the apparatus and method of the invention to produce striations, texture, grooves, strokes, or the like altering the extruded texture of a substrate or tile.
Figure 10:
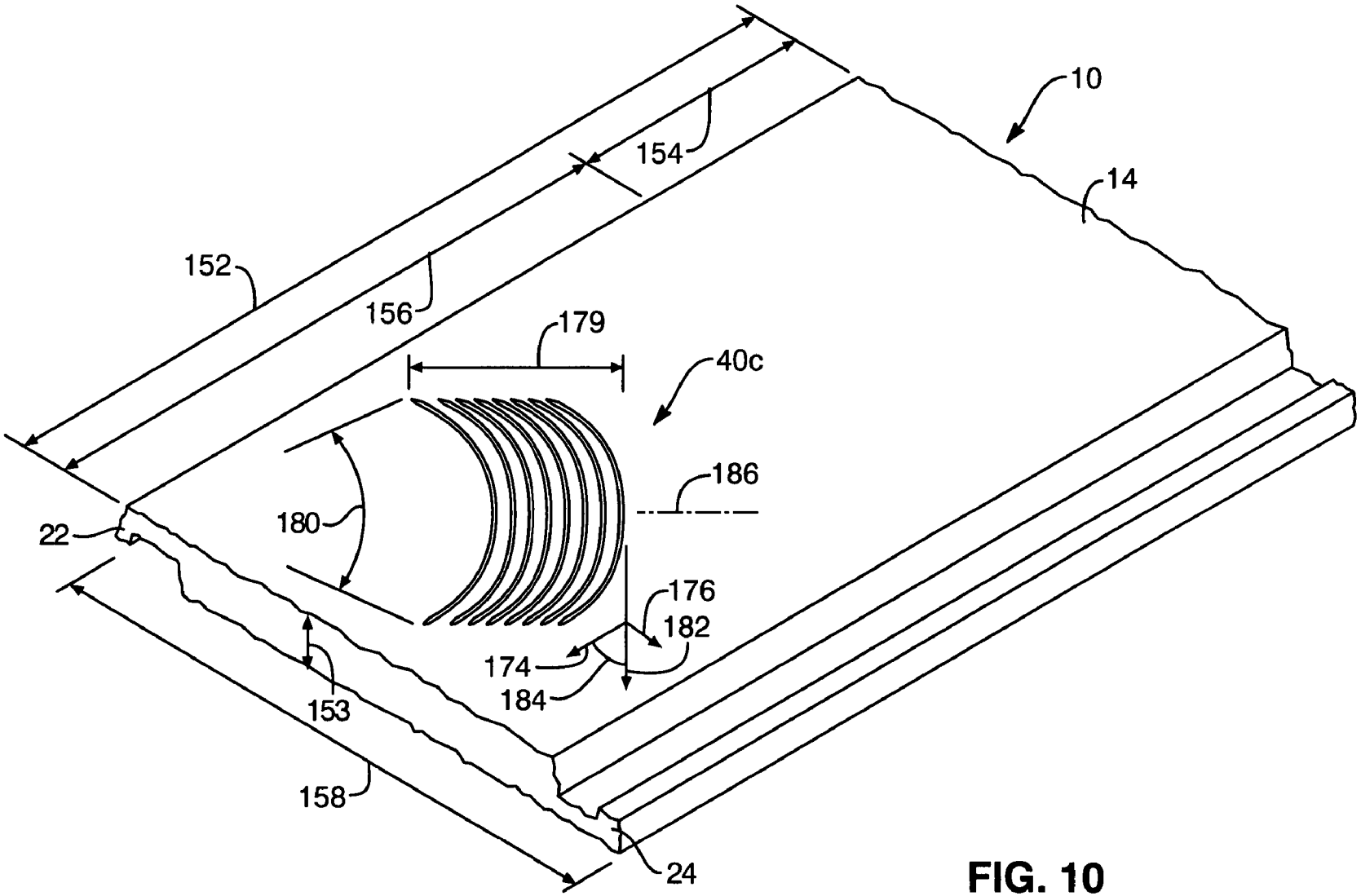
FIG. 10 is a perspective view of one embodiment of a tile or substrate made in accordance with an apparatus and method in accordance with the invention and having or providing striations, texturing, strokes, or the like having an arcuate character.

Referring to FIGS. 9-10, a stroke 40 (e.g. 40*a*, 40*b*, etc.) may be characterized by a direction 170. Similarly, an angle 172 made by the direction 170 with respect to a longitudinal axis 174 of the tile 10 may be useful. That is, a direction 170 may be specified, or may simply be measured after the fact in order to characterize the texturing of a rake 40 or stroke 40 comprising the texturing 40 of a surface 14 of a tile 10.

Likewise, angles may be measured with respect to a lateral axis 176 extending in a lateral direction across a tile 10. Typically, a length 178 of a stroke 40, and a width 179 of a stroke 40 may be used to characterize the nature thereof. As discussed above, other characteristics may include a depth 44 and height 46, as well as a width 48 of individual grooves contributing to an overall stroke 40. Thus, a number of grooves of various depths 44 and widths 48 may be produced by a bristle, screed, scraper, gouge, or other tool, as discussed herein.

Multiple strokes 40*a*, 40*b* may be made on a single tile 10. Any number of strokes 40 or striations 40 may be made. Moreover, a particular stroke 40 may change direction 170. That is, a single direction 170 is not necessarily required for a stroke 40. Moreover, a single stroke 40 may be both arcuate and angular as well as straight, all within a single stroke 40. Alternatively, multiple distinct strokes 40 may be imposed on the surface 14 of a tile 10 during manufacture.

A stroke 40*c* as in FIG. 10 may actually be arcuate in nature, forming either a long or short arc 180 characterized by a tangent 182. The tangent 182 may be taken at some point along the width 179 or length 178 of the arc 180 or stroke 40 in order to be repeatably characterized. That is, an angle 184 that the tangent 182 makes with a longitudinal axis 174, or measured from a lateral axis 176, has more meaning if defined along, for example, a centerline 186 of the included arc 180 of the stroke 40*c*. The arc 180 may be measured either as a distance minimum or distance maximum along the arc 180, or as the included angle of the arc 180. By either means, an arc 180 may be characterized, or a stroke 40*c* may be characterized by an arc 180, and other physical measurements. Accordingly, a look, effect, or the like, may be characterized according to a description of an arcuate texturing 40 of a surface 14 of a tile 10.

Figure 11:
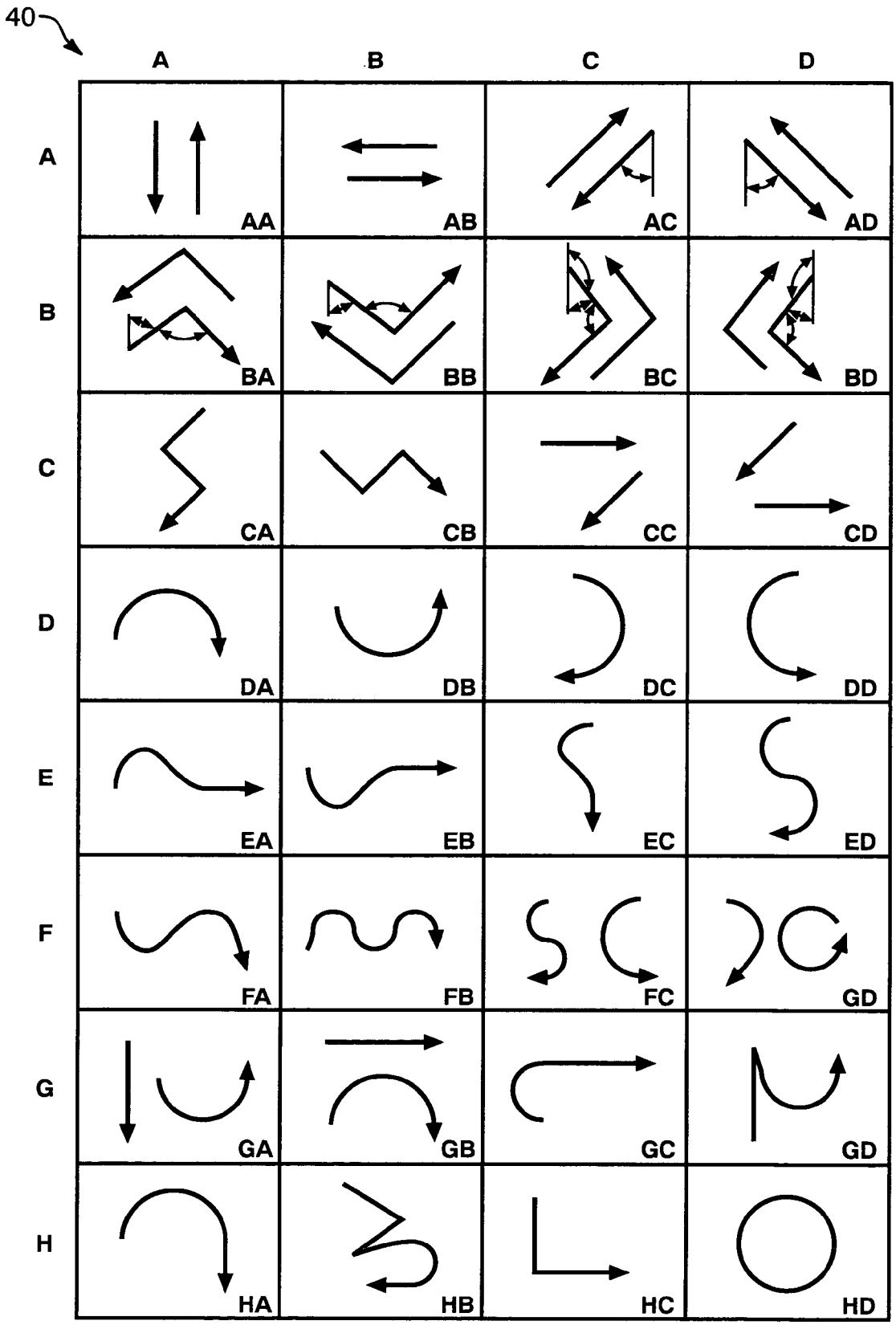
FIG. 11 is a chart providing several alternative embodiments of directional application of striations (texturing, strokes, grooves, or the like) on a top surface of a tile or other substrate.

Referring to FIG. 11, while continuing to refer generally to FIGS. 9 and 10, a stroke 40 or texturing 40 may take one of a host of optional shapes. Those shapes can be characterized in whole or in part according to the parameters discussed with respect to FIGS. 9 and 10. For example, a stroke 40 may have a direction corresponding to example AA of FIG. 11, or AB, longitudinally or laterally oriented, respectively, with respect to longitudinal axis 174 of a tile 10. Similarly, one or more directions characterized by the panel AC or AD may be used. Likewise, an angled direction such as those illustrated in panels BA, BB, BC, and BD of FIG. 11 involve a broken stroke 40 having at least two directions 170. Additional changes of direction as illustrated in panels CA, CB, and independent, individual strokes 40 in quick succession as shown in panels CC, CD may be implemented.

Arcuate configurations may include orientations and directions such as those in the panels DA, DB, DC, and DD but need not have a regular radius, as illustrated in the panels EA, EB, EC, and ED. Likewise, a degree of repetition in an individual stroke 40 may occur as illustrated in the panels FA, FB, FC or in independent strokes, as in the panels FC, FD. Other combination strokes are illustrated in the panels GA, GB, GC, and GD. Similarly, combinations of arcuate and linear portions with changes of direction along a tile 10 are illustrated in the panels HA, HB, HC, HD.

The orientations and directions, as well as the overall extent within a tile, the depths 44, heights 46, widths 48, and the like of individual grooves, as well as the widths 179 and lengths 178 of strokes, may be selected by a designer or user, or may simply be generally suggested. For example, one may suggest a completely random assortment of widths 179. However, this may be cumbersome and require multiple tools. On the other hand, a random assortment of lengths 179 or of orientation angles 172, 174 may be completely tractable quite easily by a workman, or by an automated machine.

The concepts of FIG. 11 are provided by way of example, and not by way of any comprehensive set of templates. The various illustrations in the panels of FIG. 11 merely demonstrate that a broad range of options will remain available in order to provide any amount of variation or randomness. In sidelight, the strokes 40 show up with a much more pronounced coloration, since portions thereof are lighted, and portions thereof are shadowed. The amount of shadow and light will depend upon both the depth 44 and height 46, as well as the width 48.

The number of tiles 10 having brush strokes 40 or other texturing strokes 40 may be limited, random, or any desired combination. Simply put, the particular styles and orientations thereof may be selected according to any criteria. Thus, a totally open palette is available to a designer or user. Accordingly, a designer or user may select a periodicity or frequency, a sparseness, randomness, or the like. In certain embodiments, a designer may simply specify light, medium, or heavy concentrations of a particular accent 20. Similarly, the accents 20 may be characterized by large areal coverage fractions on any given tile, or comparatively sparse areal fractions of coverage. Similarly, the areal coverage over the entire system 12 may be specified as sparse or dense, or according to another comparative.

Figure 12:
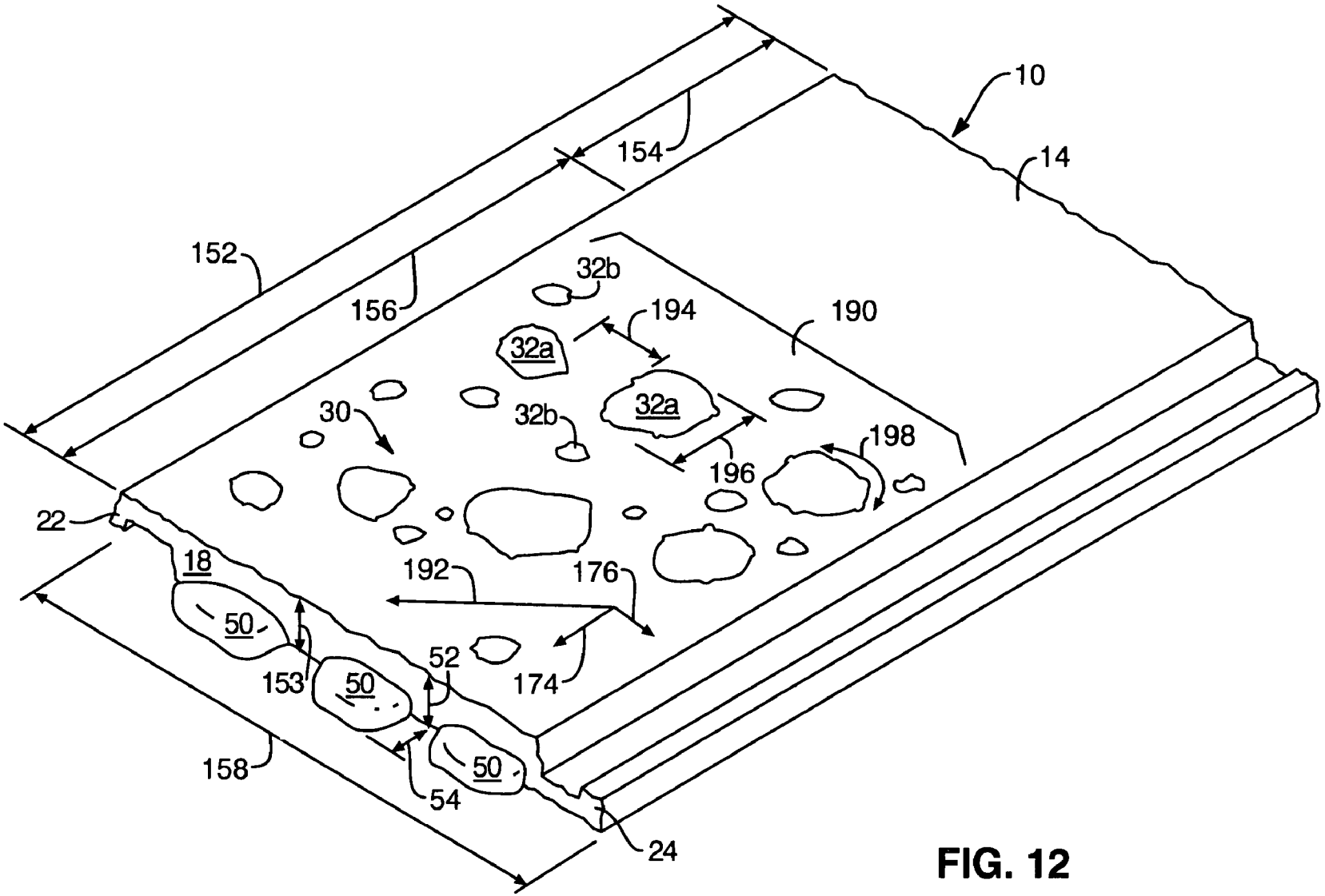
FIG. 12 is a perspective view of one embodiment of a tile made in accordance with an apparatus and method consistent with the invention and including accents or medallions of colored material applied thereto.

Referring to FIG. 12, a tile 10 may be designed and fabricated with a distribution 190 or population 190 of accents 20. The accents 20 may include, for example, both texturing strokes 40 and colored medallions 30. For example, medallions 32 having a first color may be applied along a distribution direction 192. Similarly, the medallions 32 may be separated by a medium, great, small, mean, minimum, or maximum distance 194 therebetween. The distance 194 may be measured in any particular direction, including the direction of distribution 192, along a longitudinal axis 174, lateral axis 176, or a combination thereof.

Typically, each medallion 30, and any group of medallions 30, may be characterized by a diameter 196. The diameter 196 may be calculated either as a maximum diameter, a mean diameter, an effective diameter, a hydraulic diameter, or the like. Nevertheless, the number of medallions 30 (e.g. 32*a* in the illustration of FIG. 12) will include some mean diameter 196 over all the entire population 190, as well as a minimum and a maximum diameter 196. In certain embodiments, an effective diameter may be calculated as the diameter that would exist if the entire area of an medallion were reduced to a circle. Thus, this is more of a center-of-area or centroid-of-mass-type of characterization.

In another embodiment, a hydraulic diameter may be used. A hydraulic diameter is four times the area covered by a medallion 30 divided by the wetted perimeter measured in a circumferential direction 198. In this embodiment, the degree of streaking or jagged edges is more likely to affect the effective diameter (e.g. hydraulic diameter).

These characteristics may be selected by a designer or user, or simply calculated or measured by a manufacturer based on a designer's desired appearance. That is, a designer or user may simply look at various examples and select a particular look. A manufacturer, can manufacture to provide that particular appearance or look by controlling in regular, irregular or random fashion, the parameters that characterize the tiles in that particular system 12 as viewed and selected.

The distribution 190 of medallions 30, 32 may be characterized by the region of the tile 10 in which located, by the total area covered, by the individual total area of the largest, the smallest, and the mean size of medallion 32, by the size average, by the number, by the proximity or separation distance 194, and the like. Medallions 30 may be applied to the end 18, but are typically referred to as caps 50 when located there. That is, a user or designer may specify where medallions 30 are to be placed. Nevertheless, caps 50 often represent mosses and other higher-moisture-requirement biota.

Figure 13:
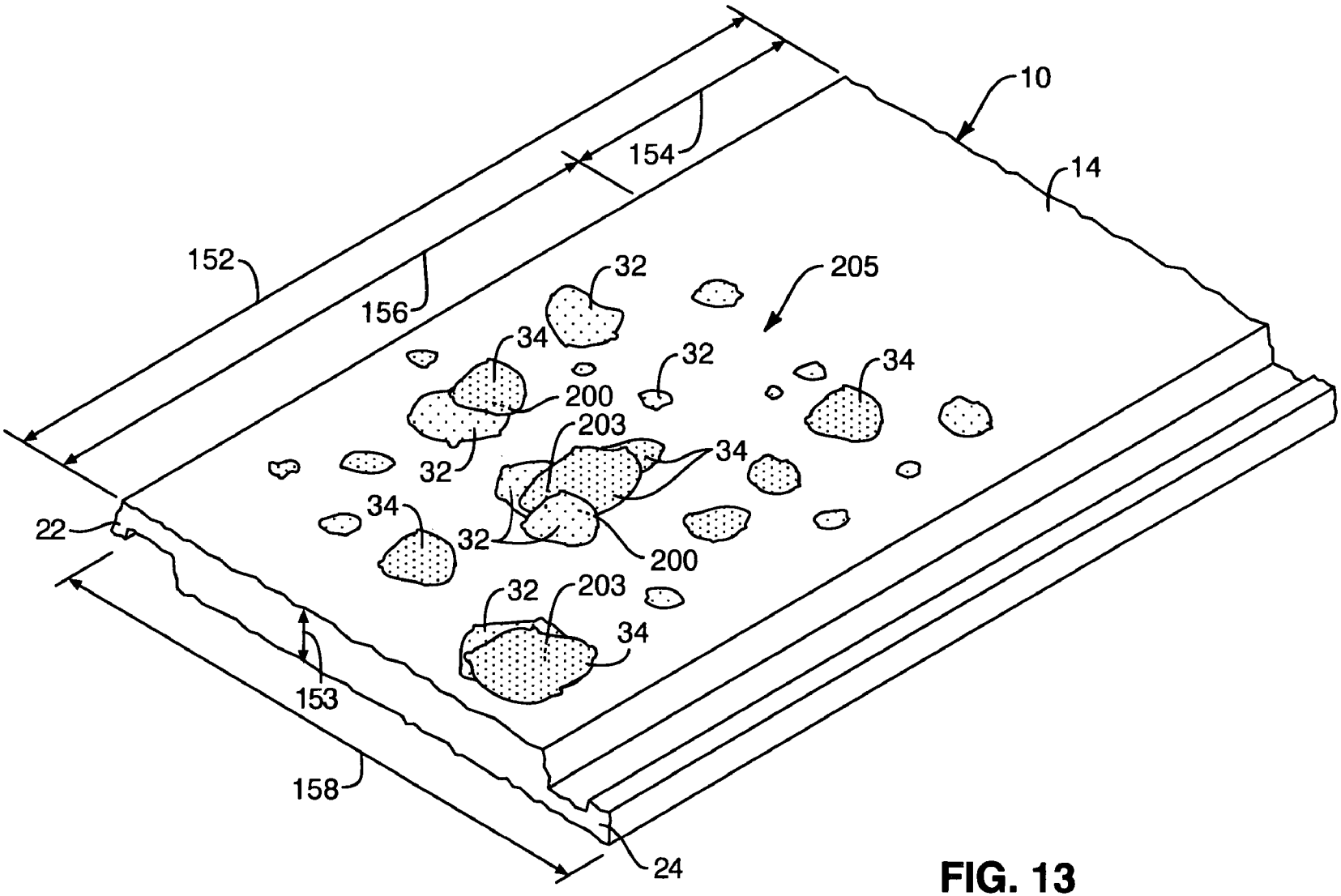
FIG. 13 is a perspective view of one embodiment of a tile or substrate having accents or medallions applied sequentially in two different colors in accordance with an apparatus and method of the invention.
Figure 14:
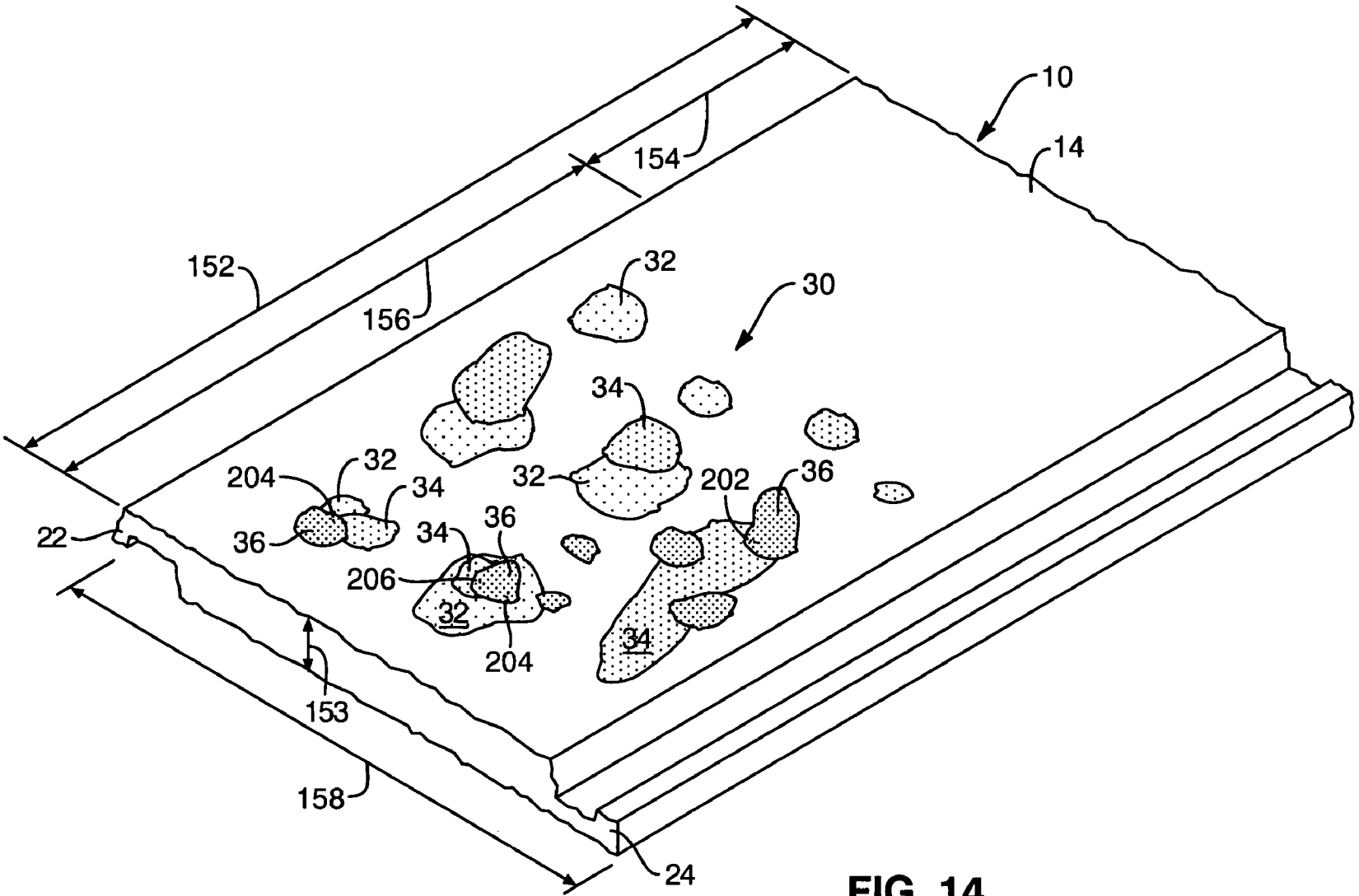
FIG. 14 is a perspective view of one embodiment of a tile or substrate having applied thereto three different colors of accents or medallions, in sequence as per a method and apparatus in accordance with the invention.

Referring to FIGS. 13-14, medallions 30 may be applied in sequence, thus causing a certain amount of overlap. For example, a region 200 is an area in which a medallion 34 overlaps a medallion 32. Typically, the color of the medallion 32*a* is different from the color of the medallion 32*b*. That is, for example, lichens 62 are typically comprised of a fungus 64 symbiotically collocated with an alga 66. Accordingly, a medallion 34 may be formed of a material having a pigment corresponding to an algae 66, while the medallions 32 may be formed from a material having a color of fungi 64. Alternatively, the colors may be those of different fungi 64.

Individual medallions 32, 34 may be isolated. Likewise, individual medallions 32, 34 may be overlapping. For example, the overlaps 200 exemplify regions where a medallion 34 overlaps a medallion 32. Similarly, a medallion 34 may overlap two already overlapping medallions 32 as in the overlap region 201. Likewise, an overlap region 203 may occur in which an accent medallion 34 is almost coextensive with an underlying medallion 32. This situation or color combination pattern occurs often in nature, and may be replicated in decorating the substrate 10 or tile 10.

In order to minimize overlap, the center 205 or centroid 205 of the medallions 32 may be in a different region of the tile 10 than the center 207 or centroid 207 of the medallions 34. In other embodiments, the centroids 205, 207 may be made coincident, crossing, or the like. This design parameter is available for use by a manufacturer in obtaining any particular appearance. As a matter of maximum utility, as far as use of material is concerned, the centroids 205, 207 may be separated in order to provide the most use of color, even though biologically inaccurate as a reflection of the organisms constituting colored patches in nature.

FIG. 14 illustrates additional regions of overlap using an additional color. In FIG. 14, the medallions 32, and the secondary or second color of medallions 34 may be augmented by an additional color of medallions 36. The medallions 30 may overlap in various, apparently random ways. For example, an overlap 200 illustrates a medallion 34 that has impinged upon a previously applied medallion 32. Similarly, being subsequent in application, a medallion 36 may be found in an overlap 202 on a medallion 34. Similarly, a medallion 36 may be found in an overlap 204 on a medallion 32. In some circumstances, multiple overlaps may include an overlap 206 of a medallion 36 on a medallion 34, that previously overlapped a medallion 32. Additional layers of medallions may be applied. However, a color scheme of three colors of medallions 30 has been found adequate in many cases.

Figure 15:
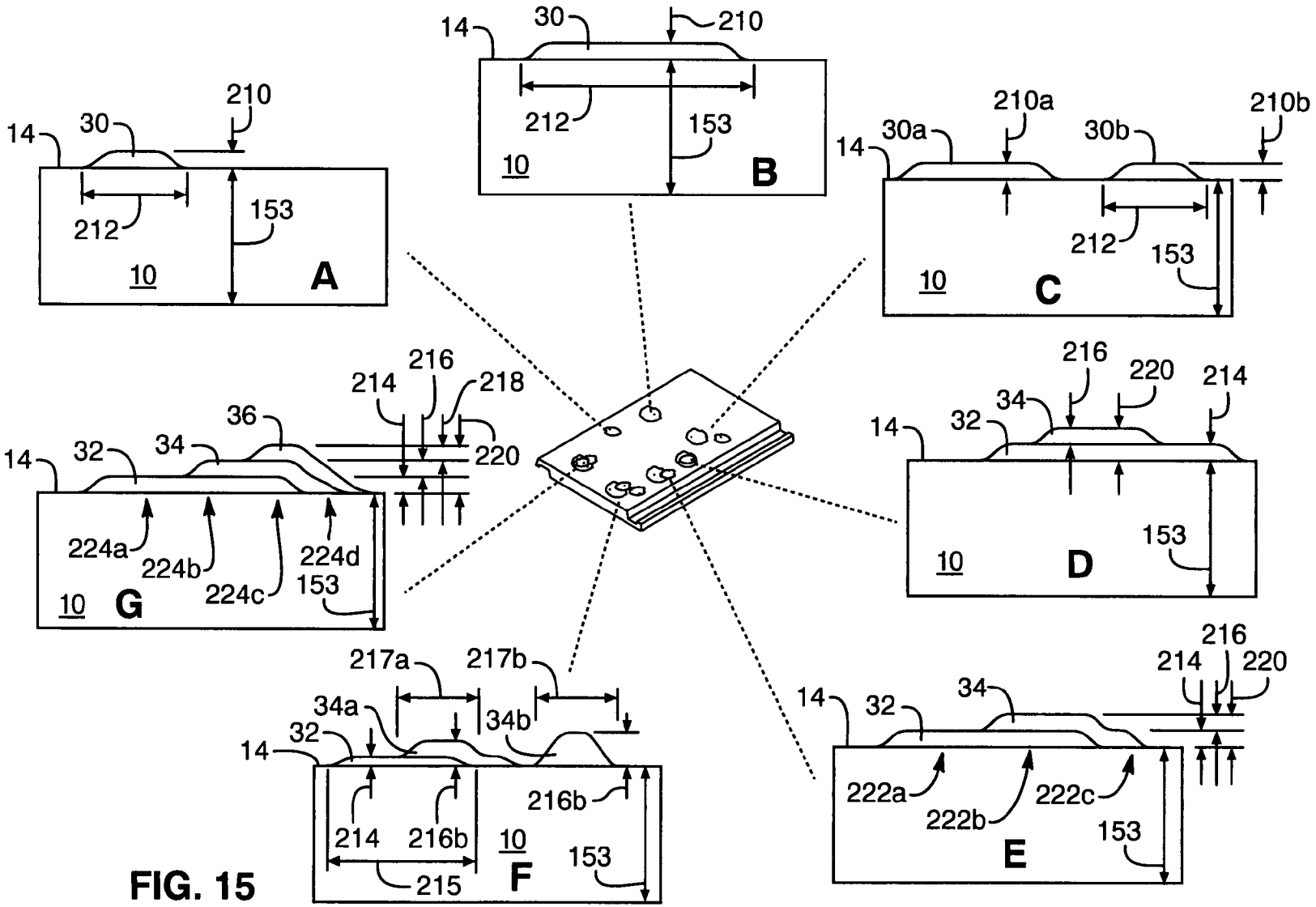
FIG. 15 is a schematic chart illustrating various applications of accent medallions to a surface of a tile in accordance with an apparatus and method of the invention.

Referring to FIG. 15, the overlap of medallions 30 on one another will result in its own concentration of materials and subsequent contribution to texturing of the tile 10. Typically, texture is most apparent in side lighting conditions. That is, early and late in a day, the sun tends to highlight variations in height by casting comparatively longer shadows. Accordingly, winter months wherein the sun is low in the sky comparatively, provide more side lighting than summer months when the sun is comparatively high. Similarly, comparatively early and late in a day, the sun is lower in the sky than during the middle of the day. Accordingly, during these early and late times of day, texturing is greatly accentuated by shadows precipitated.

Thus, in example A of FIG. 15, for example, a medallion 30 sits alone on a surface 14 of a tile 10. The medallion 30 has a maximum thickness 210, and a diameter or other characteristic length 212. In this embodiment, the height 210 is comparatively larger with respect to the thickness 153 of the tile 10 than is, for example, the thickness 210 of the medallion 30 of example B. In example B, the thickness 210 is comparatively smaller with respect to both the distance 212 or diameter 212, and with respect to the thickness 153 of the tile 10, as compared to those parameters of the medallion 30 of example A.

In example C, no longer taking medallions 30 in isolation, multiple medallions 30*a*, 30*b* may be distributed over a surface 14, each having some effective diameter 212, and some clearance from 215 with respect to other medallions 30.

Referring to example D of FIG. 15, a comparatively thin medallion 32 underlies a comparatively thick medallion 34. The medallion 34 has comparatively lower slump than the medallion 32, although both momentum and slump can effect the spread of any particular medallion 30. The thickness 216 of the medallion 34 adds comparatively more to the total thickness 220 of the stackup of multiple medallions 32, 34 on the tile 10.

Referring to example E in FIG. 15, a medallion 34 has approximately the same thickness 216 as the medallion 32. Accordingly, the region 222*a* has only the thickness 214 of the medallion 32, whereas the region 222*b* has the thickness 220 of both the medallion 32 and the medallion 34. Meanwhile, the region 222*c* has only the thickness 216 of the medallion 34.

Various combinations may arise as illustrated in examples F and G of FIG. 15. For example, a medallion 32 may have a very high slump, and an effective corresponding thickness 214 that is comparatively thin. By contrast, another medallion 34*a*, may have a thickness 216*a* substantially larger, due primarily to either more material, or lower slump, or both. Similarly, a medallion 34*b* standing alone, and having a comparatively low slump, may have a height or thickness 216*b* that is actually higher than even the entire stackup of the medallions 32, 34*a*.

Likewise, the comparative widths 215 and 217*a* may vary, based on the fact that a difference in slump may effect the eventual diameter. That is, a concentration of mass indicates that the thickness 214 and width or diameter 215 combine to form the volume of mass. Similarly, with a comparatively low slump, the width 217*a* of the medallion 34*a* is comparatively narrow, having not spread upon impact, which control may be exercised by control of momentum, constituents, aggregate, water, and so forth.

In example G, the region 224*a* includes a single medallion 32, whereas the region 224*b* includes the additional medallion 34. These two medallions have the respective thicknesses 214, and 216. In the region 224*c*, the additional medallion 36 adds its thickness 218 for a net combined thickness of 220 substantially larger. Meanwhile, as the medallions 34 and 36 extend beyond the medallion 32, the region 224*d* has a decreasing thickness reflective of only the two medallions 34, 36. Medallions may have a variety of thicknesses 214, 216, 218, 220, as well as a variety of diameters 215, 217, 219. Thus, a variety of colors and textures can be imparted to a tile, as desired by a designer, user, or the like.

Figure 16:
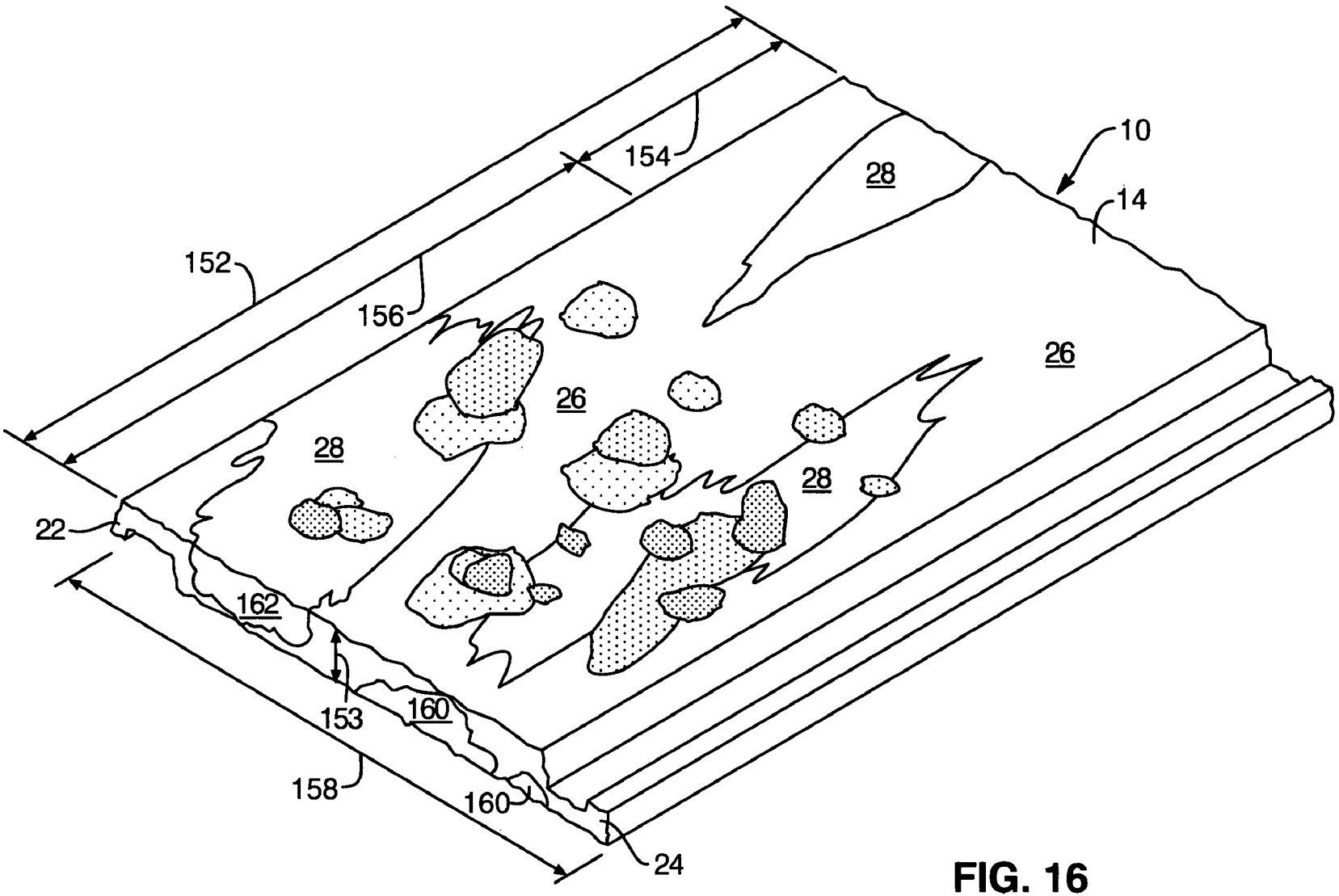
FIG. 16 is a perspective view of one embodiment of a tile or substrate formed of a base material having multiple colors integrated together, with accent medallions applied to a surface of the tile in order produce the designed effect in accordance with an apparatus and method of the invention.

Referring to FIG. 16, a combination of the many elements including all accents 20 described hereinabove may embodied in a single tile 10. For example, a base background 26 and base highlight 28 may be included in a tile 10, with a variety of medallions 30, 32, 34, 36 distributed and stacked up throughout the top surface 14, or at least the exposed region 156. Likewise, underlying the medallions 30 may include a variety, or one of a variety, of texturing 40 or strokes 40.

From the above discussion, it will be appreciated that the present invention provides accents for a cementitious substrate such as a roofing tile.

In certain embodiments, the substrate may include cement, aggregate, water, and pigment formed to have a comparatively low slump. Slump refers to the tendency of a cementitious product to flow without the application of outside force. Zero slump indicates that the aggregate within a cementitious material does not flow substantially at all from the position in which it is placed, absent the application of outside force, not its own weight. The effect of slump is to control the flow of material after all outside forces, except gravity, are removed.

In certain embodiments, slump may be comparatively high, providing for easier flow of the medallions. In other embodiments, the medallions may flow only under the momentum of impact from being thrown or otherwise discharged against the substrate. With a lower slump value, even the application by striking the substrate with momentum will tend to produce a comparatively thicker medallion, more resistant to splattering or spreading than an accent medallion applied from a material having a higher slump value.

Accent medallions may be applied using a single color, two colors, three colors, or more colors. Typically, a user will select colors that match a color scheme determined in accordance with an architectural style, look, age, or the like that is sought for artistic or decorative purposes. Meanwhile, the substrate may have a color scheme that includes one or more pigments mixed into the batch. The use of multiple colors may be integrated grossly, finely, or very grossly. That is, the comparative quantity, and the comparative frequency of the appearance of that quantity of secondary, colored material in the substrate may vary over a wide range of amounts, comparatively speaking with respect to another majority color. Thus, small areas of a secondary color with comparatively large areas of a basic or initial reference (base) color would represent fine integration. Comparatively large patches of a secondary (highlight) color within a reference or base color would represent gross integration. To the extent that color changes vary between tiles, as opposed to varying multiple times within a single tile, the integration may be considered to be very gross integration. The proportions of secondary (highlight) colors and principal (base) colors in a substrate (e.g. tile) can vary across substantially any proportion or ratio.

In certain embodiments, the accent colors may include neutral colors. That is, gray, black, brown, white, and variations of shading therein are considered neutral colors. Greens, blues, reds, yellows, and the like are typically not considered neutral colors. In some embodiments, the accent colors may include one or more neutral colors. Typically, the neutral colors of accents will be applied to the substrate first, with the non-neutral colored accents being applied later. Thus, in cases of overlap between one accent color and another, the colored medallions would dominate as the last applied medallions, in most instances. This corresponds to the natural development of lichens and mosses that provide part of the aged look of roofing tiles.

In many embodiments, a tile or substrate made in accordance with the invention may include a color scheme selected to reflect or mimic a naturally occurring event or process. For example, lichens and moss typically grow on rocks, trees, wood, shingles, tiles, and the like over time. Color, variety, extent, and the like may vary substantially with climate. Accordingly, a color scheme may be selected by a user, designer, architect, or the like to reflect local reactions to climate, or to reflect a reaction that is characteristic of a completely different location. That is, for example, the variation in color scheme, texture, and the like, promote an ability of a user or designer to select a color scheme that would be achieved in a locale over many, many years, or to achieve a foreign appearance that would never occur in the locale where a structure is actually constructed.

Typically, natural hues occurring from the presence of biota (e.g. lichens, mosses, etc.) may be used as they would appear naturally on stone, tile, or the like. Typically, the accent colors are distinct, and often highly contrasting with the colors of the base or substrate. In certain embodiments, the substrate may have substantial neutral coloring, and some of the initially applied medallions may have a neutral color, as often appears in nature.

For example, in one embodiment, the substrate may include browns, as well as deep greens. Accent medallions may include light gray, dark gray, and even a very dark gray approaching black. On top of gray medallions or brownish-gray medallions may be placed medallions containing reds, yellows, greens, bright greens, sage greens, or the like as might appear in naturally occurring lichen colonies. Ultimately, one presently contemplated use of accent medallions is to provide a random, colored, durable, design appearance that appears to be coincident with, reflective of, duplicative of, or otherwise representing a natural aging event on a roofing tile.

In certain embodiments, color schemes may be selected to coincide with reactions of mineral deposits within a substrate over a period of time of exposure to the elements of climate and weather. That is, in certain embodiments, colors may change as a result of the deposit of chemicals local to an area, or the reaction with water, air, or the like of certain constituents within a substrate. Thus, mineral reactions, such as oxidation, may occur, and the appearance thereof may be replicated or mimicked by an accent scheme of medallions applied to a substrate. The mineral deposits may be those that occur in stone, or those that occur in tiles. By either mode, a color scheme may be selected to reflect such a color scheme desired by a designer, user, architect, or the like.

In certain embodiments, the tile may be formed as a concrete material having zero slump. A suitable proportion of aggregate to cement is about one part cement to about four parts aggregate. Water may be added as required. In other embodiments, aggregate may be added to cement in a very small proportion, such as one part cement to about one-quarter part aggregate. This forms a material that is very largely cement and water, with only a minor fraction of aggregate. This makes a thin material of very high slump for medallions. Such an amount is inappropriate for the substrate. That is, medallions may be formed of the same material in the same proportions with differing pigments as compared to the substrate. Medallions may also be fabricated to be substantially thinner (with respect to aggregate), higher in pigment, high in cement, and higher in water in order to flow and spread more thinly. By the same token, clumps having more thickness extending from the top surface of a tile may be formed with accent pigments and approximately the same proportion of aggregate to cement as would be found in the substrate.

Pigments may be included in the substrate in an amount typically of about five percent of the weight of dry materials. Pigment percentages can be in any amount, but will affect cost and structure. In the accent medallion material, pigment may typically range from about 0.01 percent to as much as about twenty-five percent of the dry weight of materials. Pigment amounts of about 5 percent provide a suitably rich color, pleasing to the eye and highly saturated in many instances. Likewise, in the accent medallions, water may be from about 5 percent to about twenty-five percent. In the substrate, water may be from about five percent to about twenty-five percent of the total weight of the mix.

In certain embodiments, the ratio of cement to aggregate is 0.5. This provides a high degree of bonding, yet some additional bulk for thickness in texturing with the aggregate.

In certain embodiments, the accent medallions may be applied within a matter of seconds after formation of the substrate or tiles. Usually, cement begins to dry and cure comparatively quickly after it is no longer being worked. Medallions may be applied between a second and thirty minutes after formation of the substrate. Typically, one presently suitable embodiment of a process in accordance with the invention applies accent medallions within two minutes after formation of the substrate.

In one embodiment, medallions applied after eight minutes at a room temperature environment in an arid climate have been found suitable over a period of time. That is, after one and two years of aging, the bonding has still proven adequate.

Ten minutes after formation of the substrate, some effect on bonding of the medallions may be observed, depending upon temperature, water content, humidity, and the like. In other embodiments, such a noticeable effect may actually occur after twenty minutes. In common practice, at times over thirty minutes, formulations should be created to have sufficient water and lower temperatures in order to prevent a loss of adhesive or cohesive capability between the medallions and the substrate.

Medallions may be applied immediately upon exit from the extrusion process. In some embodiments, that time is less than one second. Typically, however, a time from about one second to eight minutes after formation of a substrate has been shown to provide adequate bonding.

As a practical matter, application of medallions may occur as tiles pass along a conveyor system from the extruder to a curing station. Accordingly, the substrate may only be available for application of the medallions, that is, only clear for application, unrestricted by the presence of machinery, storage structures, and the like, for a period of about two minutes after formation. This time period has been found to be suitable in most instances for adequate bonding of medallions to the substrate.

Medallions may be applied in sequence. Accordingly, medallions may be added to one another in the same time frames as addition of medallions to the substrate. That is, suitable bonding between a medallion accent and an underlying medallion may be just as necessary as the initial bonding of a first layer of medallions to the substrate. The same time periods used for bonding accent medallions to the substrate may be used for bonding the accent medallions to one another. Nevertheless, since the accent medallions have more cement, and more water, in most present embodiments, the application times may vary. As a practical matter, a station for applying medallions to substrates may implement multiple colors in rapid succession. Thus, the timing for application of medallions by layer may not be problematic in practice.

The water content of the material forming the accent medallions should normally be selected to provide a particular depth of elevation variation between the substrate and the medallion, or between one medallion and the next layer of medallions. That is, the depth or thickness of a layer of a medallion should provide the desired texture anticipated by a designer. Accordingly, medallions may thereby be made comparatively thicker or thinner in practice. In certain embodiments, the medallions may be selected to be comparatively thin to replicate the appearance of lichens. In other embodiments, mosses, and other biota may form a thicker layer on a material. Accordingly, medallions may be made to have a lower slump value in order to provide more thickness from the aggregate in the medallions to replicate biota that are local to a site, or native to some other area that is used as a reference in the design process for a structure.

The texturing strokes may be oriented randomly, may be placed on tiles at random, and may be arcuate, linear, angular, or a combination thereof. On any given tile, the textured stroke may be present or not present. On a given tile where the textured accent is present, it may be deep, shallow, broad, narrow, or have any of the orientations described herein. In some embodiments, designers and users prefer a more random appearance. Accordingly, the presence and orientation may both be random.

In certain embodiments, the substrate may actually be formed of any material suitable for construction. For example, rocks, clays, cements, concretes, and the like may used to form various structure. Highways, bridges, abutments, barriers, walls, and the like may all be formed by a variety of methods. Nevertheless, decoration of these structures may still be accomplished in accordance with the invention. Thus, textures, medallions, and other accents may be applied after formation of a structure in order to make the structure have an appearance similar to a more aged structure.

The texturing process may occur by manual, mechanical, automated, computer-controlled methods, or the like. For example, a workman may use a brush, broom, rake, comb, screed, spatula, or other tool to impose a texture on a surface of a material (substrate). The tool may likewise be configured in a mechanical system wherein a mechanical arm, wheel, link, or the like operates to periodically or a periodically (randomly) mark a texturing swath onto a substrate. Likewise, the occurrence of a texturing stroke as well as the nature, depth, angle, arc, or other characteristics of the texturing swath or stroke may be controlled automatically.

In certain embodiments, texturing may be done in accordance with a random or pseudorandom pattern generated by a computer and applied to the substrate. For example, in one embodiment, a computer-controlled mechanical system may mark at random times, on random tiles, in random directions, a series of texture markings or strokes. Likewise, such a system may operate to produce a periodic texturing. Nevertheless, it has been found that a more pleasing appearance, and an appearance of apparent aging is more easily achieved with more randomness to texturing and other accents.

In certain embodiments, the accent medallions may be selected in color, texture, thickness, extent, area fraction of coverage, mean space between medallions, mean effective diameter of medallions, and the like to represent or appear like various elements of aging. For example, medallions may be structured and colored to represent carbonate deposits, lime deposits, soil deposits, dust deposits, weathered aggregate, weathered cement, metal oxides, a local mineral, some other mineral, a chemical reaction of the materials in the base, propagation of biota, or the like. Biota may be selected from moss, lichens, fungi, algae, plants, symbiotic pairs of organisms other than lichens, and other groups of organisms as desired and appropriate.

In certain embodiments, local organisms or biota may be most desirable. In other environments, an appearance foreign to a local environment may be desired, and thus may be selected. In some embodiments, colors may range from pale green to dark green, as well as from cream colored to a dark brown with various shades of brown available in between.

Various yellowish color exist in nature and may range from dull almost yellow-brown to bright yellow. In certain embodiments, greens may almost appear iridescent. Certain lichens actually appear chartreuse. Mosses are typically a shade of green, gray, or brown. Cryptobiotic organisms often appear to be such a dark green that they seem black. Meanwhile, their extended and moistened color, often a bright green or emerald green, may be used. Alternatively, or additionally, the darker retracted and more arid status of a cryptobiotic organism may be represented in the accents.

Medallions may typically be characterized by the total area covered, with respect to the substrate, a diameter or effective diameter, a thickness away from the substrate, a velocity of impact against the substrate during application, momentum at impact or at application and before impact, the slump, viscosity, other characteristics of flowing ability, the order of application to the substrate, the contrast of colors with the base color scheme, the means size of medallions applied, the mean droplet size of material applied to the substrate and eventually becoming a flatter medallion, the distribution of sizes of droplets, both as to number in a size range, a means size, a maximum size, a minimum size, and the like, as well as other factors. Similarly, the medallions may be characterized by the ratios of the cement, aggregate, pigment, water, and any other materials that may be added.

For example, acrylic and silicate materials are available as additives or coatings in order to render certain cementitious materials less permeable by moisture. Likewise, polymers may be used in place of (or in addition to) water in certain materials. Nevertheless, a conventional cement mixed with aggregate, such as sand, particularly masonry sand of even consistency or the like, may be used.

Likewise, the speed, force, and momentum of medallions as sprayed or otherwise applied onto a substrate may be controlled. By designing into a process and product various controlling characteristics, one may achieve a desired effect. Similarly, by requesting a desired effect, a user may engage a manufacturer to employ various techniques in order to achieve the characteristics desired in the accent medallions, accent textures, and corresponding base colors of tiles or other substrates.

The present invention may be embodied in other specific forms without departing from its essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed and desired to be secured by United States Letters Patent is:

1. A method for decorating and installing a cementitious substrate, the method comprising:

selecting a base color scheme for a plurality of substrates formed of a cementitious material;

selecting an accent color scheme of colors distinct from the base color scheme;

providing the plurality substrates, each having the base color scheme, a substrate width in a lateral direction, a length in a longitudinal direction orthogonal to the lateral direction, and a top surface, the top surface having an exposed portion and a covered portion;

providing another cementitious material comprising water, pigment, cement, and aggregate proportioned to have substantially zero slump when applied on the top surface;

applying before curing, by impact directed substantially exclusively toward and onto the exposed portion of the top surface of each substrate of the plurality of substrates, a distribution of globules of the other cementitious material deforming to form medallions as accents, colored in the accent color scheme, the distribution varying substantially randomly in lateral width along the longitudinal direction;

the applying, further comprising forming the medallions in shape and height substantially exclusively by impact of the other cementitious material striking at least one of the top surface and other medallions previously formed on the top surface;

curing each substrate and corresponding medallions simultaneously, leaving the medallions bonded onto the top surface and extending above the top surface a distance controlled by the impact and the proportion of water, cement, and aggregate; and installing the plurality of substrates, after curing as a roof covering with the exposed portions of some of the plurality of substrates overlapping the covered portions of others of the plurality of substrates.

2. The method of claim 1, further comprising texturing the top surface of each substrate to produce a substantially random pattern before applying the accent medallions.

3. The method of claim 1 wherein each substrate comprises cement and aggregate having a proportionality with water selected to create substantially zero slump, and the other cementitious material has substantially zero slump controlled by mixing water with cement and aggregate in a ratio of from about one part cement for about four parts aggregate to about one part cement for about 0.25 parts aggregate.

4. The method of claim 1 wherein each substrate contains at least two colors of substantially the same cementitious material.

5. The method of claim 1 wherein the materials forming the base color scheme are mixed comparatively finely to form color variegations within substantially each substrate.

6. The method of claim 1 further comprising mixing the materials in the base color scheme comparatively grossly to provide variegation primarily from substrate to substrate within the plurality of substrates.

7. The method of claim 1 further comprising providing a base color scheme having at least one color distinct from the accent color scheme.

8. The method of claim 1 further comprising selecting a base color scheme having at least two colors distinct from each other.

9. The method of claim 1 further comprising selecting a base color scheme having at least one color corresponding to a neutral hue and corresponding to natural stone.

10. The method of claim 1 further comprising selecting an accent color scheme having at least one color distinct from the base color scheme.

11. The method of claim 1 further comprising selecting a base color scheme having at least one color corresponding to a natural aging event.

12. The method of claim 1 further comprising selecting an accent color scheme having at least one color distinct from the base color scheme.

13. The method of claim 1 further comprising selecting an accent color scheme having at least two colors distinct from colors of the base color scheme.

14. The method of claim 1 further comprising selecting the base color scheme by selecting colors corresponding to moss and lichens.

15. The method of claim 1 further comprising selecting the accent color scheme by selecting colors substantially corresponding to naturally occurring colors of biota.

16. The method of claim 1 further comprising selecting the accent color scheme by selecting colors substantially corresponding to naturally occurring hues of biota local to the location of installing.

17. The method of claim 1 further comprising selecting the accent color scheme by selecting colors corresponding to moss and lichens.

18. The method of claim 1 further comprising selecting an accent color scheme by selecting colors naturally occurring as a result of mineral deposits in stone.

19. The method of claim 1 wherein the medallions are formulated of a cementitious material containing cement, water, and aggregate.

20. The method of claim 19 wherein the proportions of constituents within the accent medallion are in the range of from about one part cement for about four parts aggregate to about one part cement for about 0.25 parts aggregate.

21. The method of claim 20 wherein the proportion of cement to aggregate is substantially one part cement for about two parts aggregate.

22. The method of claim 21 wherein the cement is Portland cement.

23. The method of claim 21 wherein the aggregate is sand.

24. The method of claim 23 wherein the sand is masonry sand.

25. The method of claim 19, wherein the cementitious material further comprises from about five percent to about twenty-five percent pigment.

26. The method of claim 19 where in the ratio of cement to aggregate is in a ratio of from about 0.25 to about four.

27. The method of claim 26 wherein the ratio of cement to aggregate is in a ratio of from about 0.25 to about two.

28. The method of claim 27 wherein the ratio of cement to aggregate is about 0.5.

29. The method of claim 1 wherein the medallions are applied within from about one second to about thirty minutes after formation of each substrate.

30. The method of claim 29 wherein the medallions are applied within a time from about one second to about twenty minutes after formation of each substrate.

31. The method of claim 30 wherein the medallions are applied within a time from about one second to about ten minutes after formation of each substrate.

32. The method of claim 31 wherein the medallions are applied within a time from about one second to about less than eight minutes after formation of each substrate.

33. The method of claim 32 wherein the medallions are applied within a time from about one second to about less than two minutes after formation of each substrate.

34. The method of claim 1 wherein the medallions are applied within a time selected to provide fully integrated cohesion between the medallions and each substrate.

35. The method of claim 1 wherein the medallions are applied within a time selected to provide substantially integrated cohesion between the medallions and each substrate.

36. The method of claim 1 wherein the medallions are formed of a cementitious material having a liquid content selected to provide a previously determined depth of elevation variation between each substrate and the medallion.

37. The method of claim 36 wherein the depth corresponds substantially to the texture of biota.

38. The method of claim 37 wherein the depth corresponds to biota corresponding to a location of installing.

39. The method of claim 1, further comprising texturing the top surface of each substrate in a pattern having a substantially random orientation selected from the group consisting of linear, arcuate, angular, and a combination thereof.

40. The method of claim 39 wherein the random orientation forms an acute angle with a longitudinal direction of a substrate of the plurality of substrates.

41. The method of claim 39 wherein the random orientation forms an obtuse angle with respect to a longitudinal direction of a substrate of the plurality of substrates.

42. The method of claim 39 wherein the random orientation forms a combination of two or more of a linear pattern, arcuate pattern, and angular pattern.

43. The method of claim 39 wherein at least one of the direction and accent color scheme is selected by a producer of a substrate of the plurality of substrates.

44. The method of claim 39 wherein at least one of the direction and accent color scheme is selected by the designer of a substrate of the plurality of substrates.

45. The method of claim 39 wherein at least one of the direction and accent color scheme is selected by the architect responsible for the roof covering.

46. The method of claim 39 wherein at least one of the direction and accent color scheme is selected by a user of the plurality of substrates.

47. The method of claim 39 wherein texturing comprises manually brushing a substrate of the plurality of substrates.

48. The method of claim 39 wherein texturing comprises automatically and mechanically brushing a substrate of the plurality of substrates by a mechanical device.

49. The method of claim 1, wherein at least one color in the base color scheme corresponds to at least one of carbonate deposits, lime deposits, soil deposits, weathered cement, weathered aggregate, iron oxide deposits, metal oxide deposits, biota propagation, and chemical reaction of another color of material in the base color scheme.

50. The method of claim 49 wherein the biota propagated are selected from at least one of moss, lichens, algae, and fungi.

51. The method of claim 1 wherein at least one color in the accent color scheme is selected to correspond to substantially a color selected from the group consisting of carbonate deposits, lime deposits, soil deposits, dust deposits, weathered aggregate, weathered cement, metal oxide, a local mineral, a chemical reaction of a base material, and biota propagation.

52. The method of claim 51 wherein the biota propagated are selected from moss, lichens, fungi, algae, plants, symbiotic pairs of organisms, and symbiotic groups of organisms.

53. The method of claim 51 wherein the biota are selected from an advanced, developed, slowly growing organism.

54. The method of claim 53 wherein the biota are selected from organisms local to the location of use of the substrate.

55. The method of claim 1 wherein the accent color scheme corresponds to at least one of the group consisting of pale green, dark green, brown, yellowish brown, yellow, iridescent green, greenish black, and black.

56. A method comprising:

molding a plurality of roofing tiles in an uncured cementitious material, each tile of the plurality of roofing tiles having a tile width extending in a lateral direction, a tile length extending in a longitudinal direction orthogonal to the lateral direction, and a top surface comprising an exposed portion and a covered portion;

selecting an accent color scheme substantially corresponding to naturally occurring hues of biota;

throwing by hand onto substantially exclusively the exposed portion of each tile before curing, a substantially random distribution of globules of another cementitious material having substantially zero slump and, upon impact, deforming to form medallions as accents, colored in the accent color scheme, contacting directly and substantially exclusively the exposed portion of the uncured cementitious material, the distribution varying substantially randomly in lateral width along the longitudinal direction and the medallions varying substantially randomly in mass and height along the longitudinal direction;

curing each tile and corresponding medallions simultaneously, leaving the medallions bonded onto the top surface and extending above the top surface; and installing the plurality of roofing tiles, after curing, on a roof with the exposed portions of some of the plurality of roofing tiles overlapping the covered portions of others of the plurality of roofing tiles.

57. A method comprising:

forming a tile by extruding a top surface thereof in a predetermined, constant, cross-sectional shape, the substrate having a base color scheme, a permanently uncovered portion, a covered portion, and formed of a cementitious material;

selecting an accent color scheme of colors distinct from the base color scheme;

mixing another cementitious material comprising water, cement, and aggregate by selecting the amounts thereof having substantially zero slump, in order to effectively limit spreading of the cementitious material to substantially exclusively movement in response to the momentum of impact thereof at the top surface;

hand throwing against the permanently uncovered portion, before curing, the other cementitious material, pigmented by a first color of the colors of the accent color scheme, by directing simultaneously theretoward masses of the other cementitious material randomly sized;

forming medallions, by the masses, upon impact of the masses at the top surface;

the forming, further comprising distributing the medallions in a substantially random distribution of size and location about a portion of the permanently uncovered portion;

the forming, wherein each the of medallions adopts a shape and height substantially exclusively controlled by the impact thereof at one of the top surface and another medallion on the top surface;

repeating the hand throwing and forming, by simultaneously directing masses of the other cementitious material, pigmented by a second color of the colors of the accent color scheme;

curing together the substrate and the medallions, leaving the medallions bonded onto the top surface and extending thereabove the same shape and height adopted immediately upon impact; and installing the tile in an overlapping arrangement having the permanently uncovered portion exposed.

* * * * *